US009611707B2

(12) United States Patent
Yorga et al.

(10) Patent No.: US 9,611,707 B2
(45) Date of Patent: Apr. 4, 2017

(54) TONG SYSTEM FOR TRIPPING RODS AND TUBULARS

(71) Applicants: Derrek Yorga, Calgary (CA); Derrick Jackson, Calgary (CA); Paul Knapp, Calgary (CA); Dave Richard, Calgary (CA); Minhao Yin, Calgary (CA); Harold James Miller, Calgary (CA)

(72) Inventors: Derrek Yorga, Calgary (CA); Derrick Jackson, Calgary (CA); Paul Knapp, Calgary (CA); Dave Richard, Calgary (CA); Minhao Yin, Calgary (CA); Harold James Miller, Calgary (CA)

(73) Assignee: Key Energy Services, LLC, Houston, TX (US)

( * ) Notice: Subject to any disclaimer, the term of this patent is extended or adjusted under 35 U.S.C. 154(b) by 529 days.

(21) Appl. No.: 14/084,040

(22) Filed: Nov. 19, 2013

(65) Prior Publication Data

US 2014/0138080 A1 May 22, 2014

Related U.S. Application Data

(60) Provisional application No. 61/728,156, filed on Nov. 19, 2012.

(51) Int. Cl.
*E21B 19/16* (2006.01)
*E21B 15/00* (2006.01)
(Continued)

(52) U.S. Cl.
CPC ..... *E21B 19/161* (2013.01); *E21B 7/02* (2013.01); *E21B 15/00* (2013.01); *E21B 19/00* (2013.01);
(Continued)

(58) Field of Classification Search
USPC ..... 166/77.51
See application file for complete search history.

(56) References Cited

U.S. PATENT DOCUMENTS 3,158,211 A 11/1964 McCue et al.
RE26,284 E 10/1967 O'Neill et al.
(Continued)

FOREIGN PATENT DOCUMENTS

AU 2008202799 1/2009
CN 1450246 10/2003
(Continued)

OTHER PUBLICATIONS

Copenheaver, Blaine, International Search Report and Written Opinion of the International Searching Authority for PCT/US2013/070848, Mar. 20, 2014, pp. 1-10.
(Continued)

*Primary Examiner* — Taras P Bemko
(74) *Attorney, Agent, or Firm* — King & Spalding LLP

(57) ABSTRACT

The present disclosure provides a tong system which includes a tong assembly and at least one string gripping device. The tong assembly is configured to engage a rod or tubular string at the junction between a first rod or tubular and a second rod or tubular of a rod or tubular string and unthread the first rod or tubular from the second rod or tubular. The tong assembly can also thread the first rod or tubular onto the rod or tubular string. The string gripping device is configured to hold a tubular string for at least a portion of the time. The tong system further holds the rod or tubular string against torque applied onto the first rod or tubular by the tong assembly.

21 Claims, 24 Drawing Sheets

(51) Int. Cl.

| | |
|---|---|
| ***E21B 19/08*** | (2006.01) |
| ***E21B 19/00*** | (2006.01) |
| ***E21B 19/15*** | (2006.01) |
| ***E21B 19/14*** | (2006.01) |
| ***E21B 7/02*** | (2006.01) |

(52) U.S. Cl.

CPC ..... *E21B 19/08* (2013.01); *E21B 19/14* (2013.01); *E21B 19/15* (2013.01); *E21B 19/155* (2013.01); *E21B 19/165* (2013.01)

(56) References Cited

U.S. PATENT DOCUMENTS 3,561,811 A 2/1971 Turner, Jr.
3,612,286 A 10/1971 Langowski et al.
3,616,941 A 11/1971 Walling
3,630,392 A 12/1971 Cintract et al.
3,655,071 A 4/1972 Langowski et al.
3,710,954 A 1/1973 Hutchison
3,734,208 A 5/1973 Otto
3,795,326 A 3/1974 Neilon et al.
3,844,420 A 10/1974 Walling et al.
3,858,731 A 1/1975 Briggs
3,870,109 A 3/1975 Gray
3,986,618 A 10/1976 Woolslayer et al.
4,022,284 A 5/1977 Crow
4,235,566 A 11/1980 Beeman et al.
4,274,778 A * 6/1981 Putnam ..... B25J 9/0084 175/85
4,290,495 A 9/1981 Elliston
4,290,841 A 9/1981 Fukuhara
4,315,709 A 2/1982 Gulick
4,371,041 A 2/1983 Becker et al.
4,371,302 A 2/1983 Frias et al.
4,380,297 A 4/1983 Frias
4,403,666 A 9/1983 Willis
4,403,898 A 9/1983 Thompson
4,421,179 A 12/1983 Boyadjieff
4,437,524 A 3/1984 Boyadjieff et al.
4,449,592 A 5/1984 Mayer
4,531,875 A 7/1985 Krueger
4,547,110 A 10/1985 Davidson
4,560,314 A 12/1985 Fohler
4,591,006 A 5/1986 Hutchison et al.
4,604,724 A 8/1986 Shaginian et al.
4,832,552 A 5/1989 Skelly
4,899,832 A 2/1990 Bierscheid
5,248,005 A 9/1993 Mochizuki
5,358,058 A 10/1994 Edlund et al.
5,575,344 A 11/1996 Wireman
5,711,382 A 1/1998 Hansen et al.
5,720,344 A 2/1998 Newman
5,896,793 A 4/1999 Haller et al.
5,911,803 A 6/1999 Miyano
5,988,299 A 11/1999 Hansen et al.
6,003,597 A 12/1999 Newman
6,009,811 A 1/2000 Newman et al.
6,032,739 A 3/2000 Newman
6,079,490 A 6/2000 Newman
6,082,224 A 7/2000 McDaniels et al.
6,116,345 A 9/2000 Fontana et al.
6,138,776 A 10/2000 Hart et al.
6,209,639 B1 4/2001 Newman
6,212,763 B1 4/2001 Newman
6,213,207 B1 4/2001 Newman
6,241,020 B1 6/2001 Newman
6,253,849 B1 7/2001 Newman
6,276,449 B1 8/2001 Newman
6,276,454 B1 8/2001 Fontana et al.
6,298,927 B1 10/2001 Back
6,311,788 B1 11/2001 Weixler
6,374,706 B1 4/2002 Newman
6,377,189 B1 4/2002 Newman
6,578,634 B2 6/2003 Newman
6,675,826 B1 1/2004 Newman et al.
6,705,414 B2 3/2004 Simpson et al.
6,728,638 B2 4/2004 Newman
6,758,095 B2 7/2004 Newman
6,779,614 B2 8/2004 Oser
6,826,492 B2 11/2004 Newman
6,860,337 B1 3/2005 Orr et al.
6,860,694 B2 3/2005 Slettedal
6,898,983 B2 5/2005 Newman
7,004,456 B2 2/2006 Newman
7,006,009 B2 2/2006 Newman
7,006,920 B2 2/2006 Newman et al.
7,029,422 B2 4/2006 Newman et al.
7,064,677 B2 6/2006 Newman
7,066,266 B2 6/2006 Wilkinson
7,090,035 B2 8/2006 Lesko
7,114,577 B2 10/2006 Newman
7,138,925 B2 11/2006 Nield
7,221,155 B2 5/2007 Newman
7,226,037 B2 6/2007 Newman
7,228,899 B2 6/2007 Newman et al.
7,273,104 B2 9/2007 Wilkinson
7,293,607 B2 11/2007 Lambert et al.
7,306,055 B2 12/2007 Barnes
7,308,953 B2 12/2007 Barnes
7,350,593 B1 4/2008 Brookover
7,359,801 B2 4/2008 Newman
7,431,550 B2 10/2008 Thompson
7,461,830 B2 12/2008 Newman
7,469,749 B2 12/2008 Folk
7,469,754 B2 12/2008 Landry
7,503,409 B2 3/2009 Brookover
7,505,871 B2 3/2009 Grant et al.
7,513,338 B2 4/2009 Newman
7,518,526 B2 4/2009 Newman
7,519,475 B2 4/2009 Newman
7,519,508 B2 4/2009 Newman
7,540,338 B2 6/2009 Belik
7,546,869 B2 6/2009 Lambert et al.
7,552,775 B2 6/2009 Pietras
7,571,054 B2 8/2009 Newman
7,588,083 B2 9/2009 Newman
7,631,563 B2 12/2009 Newman
7,657,376 B2 2/2010 Newman
7,672,785 B2 3/2010 Newman
7,717,193 B2 5/2010 Egilsson et al.
7,788,054 B2 8/2010 Newman
7,793,918 B2 9/2010 Newman
7,819,207 B2 10/2010 Cowan
7,837,426 B2 11/2010 Lesko
7,878,254 B2 2/2011 Abdollahi et al.
7,917,293 B2 3/2011 Newman
8,006,751 B2 8/2011 Lambert et al.
8,052,368 B2 11/2011 Littlewood et al.
8,083,009 B2 12/2011 Comacchio et al.
8,186,455 B2 5/2012 Childers et al.
8,215,417 B2 7/2012 Annaiyappa et al.
8,215,887 B2 7/2012 Fikowski et al.
8,215,888 B2 7/2012 Tetley et al.
8,232,892 B2 7/2012 Overholt et al.
8,261,855 B2 9/2012 Stacy et al.
8,280,636 B2 10/2012 Newman
8,280,639 B2 10/2012 Conquergood et al.
8,839,881 B1 9/2014 Baumler
2001/0000550 A1 5/2001 Newman
2001/0000832 A1 5/2001 Newman
2002/0153134 A1 10/2002 Newman
2002/0156582 A1 10/2002 Newman
2002/0156591 A1 10/2002 Newman
2002/0156670 A1 10/2002 Newman
2002/0156730 A1 10/2002 Newman
2003/0042020 A1 3/2003 Newman
2003/0075023 A1 4/2003 Robichaux
2003/0183382 A1 10/2003 Newman
2003/0188584 A1 10/2003 Newman
2003/0196798 A1 10/2003 Newman
2004/0065874 A1 4/2004 Newman
2004/0089076 A1 5/2004 Newman
2004/0162658 A1 8/2004 Newman
2004/0188088 A1 9/2004 Newman et al.

(56) References Cited

U.S. PATENT DOCUMENTS

| | | | |
|---|---|---|---|
| 2004/0192507 | A1 | 9/2004 | Newman et al. |
| 2004/0196032 | A1 | 10/2004 | Newman |
| 2004/0208730 | A1 | 10/2004 | Morelli et al. |
| 2005/0074307 | A1 | 4/2005 | Guarisco, Sr. et al. |
| 2005/0103491 | A1 | 5/2005 | Newman et al. |
| 2005/0114001 | A1 | 5/2005 | Newman |
| 2005/0173154 | A1 | 8/2005 | Lesko |
| 2005/0199388 | A1 | 9/2005 | Newman |
| 2005/0252279 | A1 | 11/2005 | Newman |
| 2005/0269072 | A1 | 12/2005 | Folk et al. |
| 2006/0021753 | A1 | 2/2006 | Wilkinson |
| 2006/0045655 | A1 | 3/2006 | Wells |
| 2006/0124356 | A1 | 6/2006 | Gust et al. |
| 2006/0163545 | A1 | 7/2006 | Newman |
| 2006/0243488 | A1 | 11/2006 | Pietras |
| 2007/0031215 | A1 | 2/2007 | Belik |
| 2007/0056727 | A1 | 3/2007 | Newman |
| 2007/0056746 | A1 | 3/2007 | Newman |
| 2007/0056811 | A1 | 3/2007 | Newman |
| 2007/0067107 | A1 | 3/2007 | Newman |
| 2007/0089878 | A1 | 4/2007 | Newman |
| 2007/0092358 | A1 | 4/2007 | Innes et al. |
| 2007/0227225 | A1 | 10/2007 | Newman |
| 2007/0288169 | A1 | 12/2007 | Newman |
| 2008/0035333 | A1 | 2/2008 | Newman |
| 2008/0035334 | A1 | 2/2008 | Newman |
| 2008/0035335 | A1 | 2/2008 | Newman |
| 2008/0037368 | A1 | 2/2008 | Newman |
| 2008/0038093 | A1 | 2/2008 | Lambert et al. |
| 2008/0101891 | A1 | 5/2008 | Belik |
| 2008/0164064 | A1 | 7/2008 | Belik et al. |
| 2008/0177450 | A1 | 7/2008 | Daniel |
| 2009/0008081 | A1 | 1/2009 | Bouligny |
| 2009/0053013 | A1 | 2/2009 | Maltby |
| 2009/0056467 | A1 | 3/2009 | Newman |
| 2009/0057630 | A1 | 3/2009 | Newman |
| 2009/0063054 | A1 | 3/2009 | Newman |
| 2009/0071720 | A1 | 3/2009 | Cowan |
| 2009/0084558 | A1 | 4/2009 | Bloom |
| 2009/0200086 | A1 | 8/2009 | Bagassi |
| 2009/0252576 | A1 | 10/2009 | Gerber et al. |
| 2010/0068006 | A1 | 3/2010 | Littlewood et al. |
| 2010/0132180 | A1 | 6/2010 | Conquergood et al. |
| 2010/0138159 | A1 | 6/2010 | Conquergood et al. |
| 2010/0200297 | A1 | 8/2010 | Comacchio et al. |
| 2011/0070054 | A1 | 3/2011 | Crossley et al. |
| 2011/0079568 | A1 | 4/2011 | Mau et al. |
| 2011/0083840 | A1 | 4/2011 | Wiedmer et al. |
| 2011/0091304 | A1 | 4/2011 | Tetley et al. |
| 2011/0108323 | A1 | 5/2011 | Stacy |
| 2011/0128160 | A1 | 6/2011 | Overholt et al. |
| 2011/0180266 | A1 | 7/2011 | Elmbo et al. |
| 2011/0188973 | A1 | 8/2011 | Baumler |
| 2011/0214856 | A1 | 9/2011 | Newman |
| 2011/0313626 | A1 | 12/2011 | Bowen et al. |
| 2012/0109526 | A1 | 5/2012 | Conine et al. |
| 2012/0111155 | A1 | 5/2012 | Holen |
| 2012/0130537 | A1 | 5/2012 | Gerber |
| 2012/0137833 | A1 | 6/2012 | Pettit |
| 2012/0167485 | A1 | 7/2012 | Trevithick et al. |
| 2012/0210827 | A1 | 8/2012 | Hickman |
| 2012/0255775 | A1 | 10/2012 | Stacy et al. |
| 2013/0255446 | A1 | 10/2013 | Taggart |
| 2013/0343838 | A1 | 12/2013 | Flusche |

FOREIGN PATENT DOCUMENTS

| | | |
|---|---|---|
| CN | 1920239 | 2/2007 |
| CN | 201144798 | 11/2008 |
| CN | 101429856 | 5/2009 |
| CN | 201314225 | 9/2009 |
| WO | 9817891 | 4/1998 |
| WO | 9918322 | 4/1999 |
| WO | 2004048249 | 6/2004 |
| WO | 2004065754 | 8/2004 |
| WO | 2004074159 | 9/2004 |
| WO | 2004074631 | 9/2004 |
| WO | 2005033907 | 4/2005 |
| WO | 2005084246 | 9/2005 |
| WO | 2005094505 | 10/2005 |
| WO | 2007032987 | 3/2007 |
| WO | 2007033001 | 3/2007 |
| WO | 2007112324 | 10/2007 |
| WO | 2007112333 | 10/2007 |
| WO | 2007112363 | 10/2007 |
| WO | 2007112373 | 10/2007 |
| WO | 2007130756 | 11/2007 |
| WO | 2011011888 | 2/2011 |

OTHER PUBLICATIONS

Copenheaver, Blaine, International Search Report and Written Opinion of the International Searching Authority for PCT/US2013/070843, Mar. 20, 2014, pp. 1-15.

Copenheaver, Blaine, International Search Report and Written Opinion of the International Searching Authority for PCT/US2013/070852, Mar. 19, 2014, pp. 1-9.

Copenheaver, Blaine, International Search Report and Written Opinion of the International Searching Authority for PCT/US2013/070847, Mar. 20, 2014, pp. 1-8.

Copenheaver, Blaine, International Search Report and Written Opinion of the International Searching Authority for PCT/US2013/070850, Mar. 20, 2014, pp. 1-7.

Copenheaver, Blaine, International Search Report and Written Opinion of the International Searching Authority for PCT/US2013/070856, Mar. 23, 2014, pp. 1-6.

* cited by examiner

TONG SYSTEM FOR TRIPPING RODS AND TUBULARS

CROSS-REFERENCE TO RELATED APPLICATIONS

This application claims priority under 35 U.S.C. §119 to U.S. Provisional Patent Application No. 61/728,156, titled "Automated Workover Rig System," filed on Nov. 19, 2012, the entirety of which is incorporated by reference herein.

The present application is related also to U.S. patent application Ser. No. 14/083,978, entitled "Mechanized and Automated Well Service Rig System," filed with the U.S. Patent and Trademark Office on Nov. 19, 2013, and whose entire contents are hereby incorporated herein by reference.

The present application is related also to U.S. patent application Ser. No. 14/083,996, entitled "Mechanized and Automated Well Service Rig," filed with the U.S. Patent and Trademark Office on Nov. 19, 2013, and whose entire contents are hereby incorporated herein by reference.

The present application is related also to U.S. patent application Ser. No. 14/084,017, entitled "Mechanized and Automated Catwalk System," filed with the U.S. Patent and Trademark Office on Nov. 19, 2013, and whose entire contents are hereby incorporated herein by reference.

The present application is related also to U.S. patent application Ser. No. 14/084,089, entitled "Methods of Mechanized and Automated Tripping of Rods and Tubulars," filed with the U.S. Patent and Trademark Office on Nov. 19, 2013, and whose entire contents are hereby incorporated herein by reference.

The present application is related also to U.S. patent application Ser. No. 14/084,206, entitled "Rod and Tubular Racking System," filed with the U.S. Patent and Trademark Office on Nov. 19, 2013, and whose entire contents are hereby incorporated herein by reference.

TECHNICAL FIELD

This disclosure relates generally to well service systems and, more particularly, to a tong system for tripping rods and tubulars.

BACKGROUND OF THE INVENTION

During the production life cycle of an oil well, a rod string or tubular string may need to be pulled out of hole or run into hole for various reasons. For example, to initiate controlled recovery, a tubular string is run down-hole to provide a controlled pathway for fluid resources to be brought from the well to the surface. A sucker rod string may also be run down-hole to actuate a pump installed within the well. In some cases, after a tubular string and/or a rod string is initially run down-hole, the tubular string and/or rod string may need to be pulled out of hole for repair or maintenance of the well or other down-hole equipment. Thus, the tubular string and/or rod string are pulled out of hole mid-production and then run back in after the necessary maintenance is completed. At the end of a wells production life, the tubular string and/or rod string is likewise pulled out of hole.

The processes of pulling a rod string or tubular string out of a well and running a rod string or tubular string into a well are examples of a class of operations known as tripping. Tripping operations typically require several large pieces of equipment to perform various aspects of the processes. For example, as a rod string or tubular string is pulled out of hole, the string segments, which are generally threaded together at the ends to form the string, are to be unthreaded from each other as they are lifted out of hole. Typically, a tong device is used to rotate a segment or coupling from the rest of the string to unthread the segment from the string. Conventionally, such task requires an operator to interface with the tong device or even to actuate the tong device. In addition to requiring operator interfacing for unthreading string segments, typical tripping processes and the equipment involved require a significant amount of human intervention.

Furthermore, many wells utilize both tubular and rods down-hole. Thus, both rod tripping processes and tubular tripping processes will need to be performed for such wells. However, rods and tubulars require different handling. Thus, generally, different equipment is used to handle rods and tubulars. Specifically, rods, which are thinner and more fragile than tubulars require special handling to avoid damage to the rods. However, conventional tripping equipment and methods are generally not suitable for handling rods, and are not flexible between handling rods and handling tubulars. Typical tripping equipment also lacks a degree of flexibility, customizable control, and efficiency that could improve the cost, time, and operator experience of the process.

SUMMARY

These and other aspects, features and embodiments of the invention will become apparent to a person of ordinary skill in the art upon consideration of the following detailed description of illustrated embodiments exemplifying the best mode for carrying out the invention as presently perceived.

According to an aspect of the present disclosure, A well service rig system includes a well service rig, a catwalk, and a tong system. The well service rig includes a rig base unit and a mast coupled to the rig base unit and movable between a folded position and an upright position. The well service rig further includes a vertical guide supported from the mast, and a traveling block system coupled to the vertical guide configured to travel at least a portion of the vertical guide. The catwalk includes a unit comprising a first end, a second end, a first side and a second side. The catwalk further includes a carriage disposed on the unit and movable between a horizontal position, a raised position, and a telescoping position. The catwalk further includes a racking system coupled to the unit and movable between a transport position and an operational position. In the transport position, the racking system is folded into the first and/or second sides of the unit. In the operational position, the racking system extends out from the first and/or second sides of the unit. The racking system is configured to store, feed, or receive a plurality tubulars and/or a plurality of rods. The tong system includes a clamp or a slip configured to hold and support a rod or tubular string, respectively. The tong system further includes a tong assembly configured to hold and twist a first rod or tubular in relation to the rod or tubular string, threading or unthreading the first rod or tubular to or from the rod or tubular string.

According to an aspect of the present disclosure, a well service rig system includes a well service rig, a catwalk system, and a tong system. The well service rig includes a mast and a vertical guide supported from the mast. The well service rig further includes a traveling block system coupled to the vertical guide configured to travel at least a portion of the vertical guide, the traveling block system configured to pick up and raise or lower a rod or tubular. The catwalk includes a catwalk unit configured to deliver or receive the rod tubular to or from the traveling guide. The catwalk further includes a racking system coupled to the catwalk unit, the racking system configured to store the rod or tubular, feed the rod or tubular onto the catwalk unit, and/or receive the tubular or the rod from the catwalk unit. The tong system includes a clamp or a slip configured to hold and support a rod or tubular string, respectively. The tong system further includes a tong assembly configured to hold and twist the rod or tubular in relation to the rod or tubular string, threading or unthreading the rod or tubular to or from the rod or tubular string.

According to an aspect of the present disclosure, a well service rig system includes a well service rig and a catwalk. The well service rig includes a rig base unit, a mast coupled to the rig base unit. The mast is movable between a folded position and an upright position. The well service rig further includes a vertical guide supported from the mast, and a traveling block system coupled to the vertical guide configured to travel at least a portion of the vertical guide. The catwalk further includes a unit comprising a first end, a second end, a first side and a second side. The catwalk further includes a carriage disposed on the unit and movable between a horizontal position, a raised position, and a telescoping position. The catwalk further includes a racking system coupled to the unit and movable between a transport position and an operational position. In the transport position, the racking system is folded into the first and/or second sides of the unit. In the operational position, the racking system extends out from the first and/or second sides of the unit. The racking system is configured to store, feed, or receive a plurality tubulars and/or a plurality of rods.

According to an aspect of the present disclosure, a well service rig for tripping rods and tubulars includes a service rig base unit, a mast coupled to the well service rig base unit movable between a folded position and an upright position, a vertical guide mounted to the mast, and a traveling block system coupled to the vertical guide at a first end and configured to travel up and down at least a portion of a length of the vertical guide. The traveling block system couplable to a rod, a tubular, or both at a second end.

According to an aspect of the present disclosure, a vertical tracking guide includes a linear shaft suspended from a mast of a service rig. The linear shaft is coupled to a traveling block system, and the traveling block system configured to travel at least a portion of the linear shaft.

According to an aspect of the present disclosure, a service rig traveling block system includes a block guide configured to couple to and travel along a vertical guide. The traveling block system further includes a block body coupled to the block guide. The traveling block system further includes a rotating dial coupled to the block body. The traveling block system further includes a link tilt system comprising a proximal end and a distal end, the proximal end being coupled to the rotation dial, wherein the rotation dial rotates the link tilt system into a plurality of positions relative to the block body. The traveling block system also includes an elevator coupled to the distal end of the link tilt system and configured to pick up a rod or a tubular, respectively.

According to an aspect of the present disclosure, a catwalk system includes a unit having a first end, a second end, a first side, and a second side, in which the first and second sides extend from the first end to the second end, and the first side is opposite the second side. The catwalk system further includes a carriage disposed on the unit and coupled to the unit at the second end and extending towards the first end. The carriage is movable between a horizontal position and a sloped position, and between an extended position and a retracted position. The catwalk system further includes a racking system coupled to the first side of the unit, the second side of the unit, or both. The racking system comprising a plurality of racking layers configured to store and support a plurality of rods and/or tubulars.

According to an aspect of the present disclosure, a catwalk system includes a unit having a first end, a second end, a first side, and a second side, in which the first and second sides extend from the first end to the second end, and the first side is opposite the second side. A carriage is disposed on the unit and coupled at the second end and extending towards the first end. The carriage is movable between a horizontal position and a sloped position and a telescoping position. The catwalk system further includes a racking system coupled to the first side of the unit, the second side of the unit, or both. The racking system comprising a plurality of base beams, each of the plurality of base beams comprising a coupling end and a distal end, and coupled to the unit at the coupling end. The plurality of base beams extend from the unit in the operational position. The plurality of base beams are configured to support a plurality of rods, a plurality of tubulars, or both. The racking system further includes a plurality of indexers coupled to the first, second, or both sides of the unit. Each of the plurality of indexers comprises a series of rotating holders configured to transport rods and tubulars between the carriage and the plurality of base beams. The racking system further includes a jack coupled to each of the plurality of base beams at a distal end opposite the unit in the operational position. The jack is configured to raise or lower the distal end of the base beam relative to the coupling end.

According to an aspect of the present disclosure, a catwalk system includes a unit having a first end, a second end, a first side, and a second side. The first and second sides extend from the first end to the second end, and the first side is opposite the second side. The catwalk system further includes a carriage disposed on the unit and coupled at the second end and extending towards the first end. The carriage is movable between a horizontal position and a sloped and telescoping position. The catwalk system further includes a racking system coupled to the first side of the unit, the second side of the unit, or both. The racking system is configured to store, feed, and/or receive a plurality of tubulars and/or rods. The racking system is movable between a transport position in which the racking system is folded along the first, second, or both sides of the unit and an operational position in which the racking system extends outwardly from the first, second, or both sides of the unit.

According to an aspect of the present disclosure, a racking system includes a rack comprising a plurality of beams configured to support a plurality of rods, a plurality of tubulars, or both, each of the plurality of beams comprising a proximal end and a distal end. The racking system further includes a plurality of indexers aligned with or proximal to the proximal ends of the plurality of base beams, wherein each of the plurality of indexers comprises a series of rotating holders configured to transport the plurality of rods, tubulars, or both to and from the rack. Additionally, the racking system further includes a jack coupled to the distal end each of the plurality of base beams, wherein the jack raises and lowers the distal end of the base beam in relation to the proximal end.

According to an aspect of the present disclosure, a method of receiving and storing a plurality of rods or tubulars includes receiving a rod or tubular onto a rotating holder of an indexer, and rotating the indexer and transporting the rod or tubular from a first side of the indexer to a second side of the indexer, the second side opposite the first side. The method further includes discharging the rod or tubular onto a rack disposed adjacent the second side of the indexer, the rack comprising a plurality of base beams, wherein each of the plurality of base beams comprised a proximal end. The method further includes receiving the rod or tubular onto the rack.

According to an aspect of the present disclosure, a method of delivering a plurality of rods or tubulars includes delivering a rod or tubular onto a holder of an indexer from a rack, and rotating the indexer and transporting the rod or tubular from a second side of the indexer to a first side of the indexer, the second side opposite the first side. The method further includes discharging the rod or tubular from the indexer onto a receiving device on the first side of the indexer.

According to an aspect of the present disclosure, a tong system for handling rods includes a base and a rod clamp disposed on the base. The rod clamp comprising a first clamp block and a second clamp block opposite the first clamp block. The first clamp block comprises a first clamp piston and a first clamp die disposed at a distal end of the first clamp piston. Likewise, the second clamp block comprises a second clamp piston and a second clamp die disposed at a distal end of the second clamp piston. The first and second clamp dies face each other. The tong system for handling rods further includes a rod positioner assembly coupled above the rod clamp via at least one hydraulic cylinder, the rod positioner configured to position and hold a rod via an opening formed therein. The tong system for handling rods further includes a tong assembly. The tong assembly is disposed on the base via a riser and a horizontal track, the tong assembly comprising a rod handling tong and a lower centralizer guide positioned above the rod handling tong. The tong system for handling rods also includes a centralizer arm extending from the base to a height above the lower centralizer guide. The centralizer arm further comprises a guide member.

According to an aspect of the present disclosure, a tong system for handling tubulars includes a base and a tubing slip disposed above the base. The tubing slip is configured to receive a tubular therethrough. The tong system for handling tubulars further includes a tong assembly disposed on the base via a riser and a horizontal track. The tong assembly includes a tubular handling tong configured to engage and thread or unthread the tubular to or from a tubular string. The tong assembly further includes a tubular backup and a lower centralizer guide positioned above the tubular handling tong. The tong system also includes a centralizer arm extending from the base to a height above the lower centralizer guide, the centralizer arm comprising a guide member.

According to an aspect of the present disclosure, a method of pulling a rod out of a well hole includes lifting a rod string through a disengaged rod positioner with a traveling block system until a junction between a first rod of the rod string and a second rod of the rod string is above the rod positioner. The method also includes engaging the rod positioner onto the second rod, wherein the rod positioner holds the second rod in a stationary position, and suspending the rod string in the rod positioner. The method further includes engaging a tong assembly onto the first rod, wherein the tong assembly twists the first rod and unthreads the first rod from the second rod. Then the method includes disengaging the tong assembly from the first rod, and lowering and placing the first rod onto a carriage, wherein the carriage is raised at an angle. The method further includes releasing the first rod from the traveling block system and lowering the carriage into a horizontal position. The method also includes tilting the carriage and discharging the rod from the carriage onto a rod racking system.

According to an aspect of the present disclosure, a method of pulling a tubular out of a well hole includes lifting a tubular string through a disengaged tubing slip with a traveling block system until a junction between a first tubular of the tubular string and a second tubular of the tubular string is above the tubing slip. The method further includes engaging the tubing slip onto the second tubular of the tubular string, wherein the tubing slip holds the second tubular in a stationary position, and suspending the tubular string from the tubing slip. The method also includes engaging a tong assembly onto the first tubular, wherein the tong assembly twists the first tubular and unthreads the first tubular from the second tubular. The method also includes disengaging the tong assembly from the first tubular, and lowering and placing the first tubular onto a carriage, wherein the carriage is raised at an angle. The method further includes lowering the carriage into a horizontal position, tilting the carriage, and discharging the tubular from the carriage onto a tubular racking system.

According to an aspect of the present disclosure, a method of running a rod into a well hole includes delivering a first rod from a rod racking system onto a carriage via an indexer, and raising the carriage from a horizontal position into a sloped and extended or telescoped position. The method also includes engaging a traveling block system with the first rod via a rod elevator of a traveling block system, lifting the first rod from the carriage, and suspending the first rod from the traveling block system above a tong system. The tong system comprises a tong assembly, an upper centralizer, a lower centralizer, a rod positioner, and a rod clamp, the upper centralizer aligning the first rod with the lower centralizer. The method also includes suspending a rod string by the rod positioner, and engaging a rod flat backup onto one or more rod flats of the rod string. The method further includes lowering the first rod through the lower centralizer of the tong assembly onto the rod string, and engaging the tong assembly onto the first rod and threading the first rod onto the rod string.

According to an aspect of the present disclosure, a method of running a tubular into a well hole includes delivering a first tubular from a tubular racking system onto a carriage via an indexer. The method also includes raising the carriage from a horizontal position into a sloped and telescoped position. The method also includes engaging the first tubular to a tubular elevator of a traveling block system, lifting the first tubular from the carriage, and suspending the first tubular from the traveling block system above a tong system. The tong system comprises a tong assembly, an upper centralizer, a lower centralizer, and a tubing slip, the upper centralizer aligning the first tubular with the lower centralizer. The method further includes suspending a tubular string from an engaged tubing slip. The method also includes lowering the first tubular through the lower centralizer and onto the tubular string, engaging the tong assembly onto the first tubular, and threading the first tubular onto the tubular string.

BRIEF DESCRIPTION OF THE DRAWINGS

For a more complete understanding of the claimed invention and the advantages thereof, reference is now made to the following description, in conjunction with the accompanying figures briefly described as follows. In the drawings, reference numerals designate like or corresponding, but not necessarily identical, elements. The drawings illustrate only example embodiments of methods, systems, and devices for carrying out a class of operations known as tripping and are therefore not to be considered limiting of its scope, such method, systems, and device may admit to other equally effective embodiments that fall within the scope of the present disclosure. The elements and features shown in the drawings are not necessarily to scale, emphasis instead being placed upon clearly illustrating the principles of the example embodiments. Additionally, certain dimensions or positionings may be exaggerated to help visually convey such principles. The methods shown in the drawings illustrate certain steps for carrying out the techniques of this disclosure. However, the methods may include more or less steps than explicitly illustrated in the example embodiments. Two or more of the illustrated steps may be combined into one step or performed in an alternate order. Moreover, one or more steps in the illustrated methods may be replaced by one or more equivalent steps known in the art to be interchangeable with the illustrated step(s). In one or more embodiments, one or more of the features shown in each of the figures may be omitted, added, repeated, and/or substituted. Accordingly, embodiments of the present disclosure should not be limited to the specific arrangements of components shown in these figures.

DETAILED DESCRIPTION OF THE EXAMPLE EMBODIMENTS

In the following detailed description of the example embodiments, numerous specific details are set forth in order to provide a more thorough understanding of the disclosure herein. However, it will be apparent to one of ordinary skill the art that the example embodiments herein may be practiced without these specific details. In other instances, well-known features have not been described in detail to avoid unnecessarily complicating the description. As used herein, a length, a width, and a height can each generally be described as lateral directions.

Designations such as "first", "second", and "third" are merely used to call out distinct features rather than a total number of items. Descriptions such as "top", "bottom", "distal", and "proximal" are meant to describe different portions of an element or component and are not meant to imply an absolute orientation. Furthermore, descriptions such as "above", "below", "to the side of", and "adjacent to" are meant to describe a special relationship between two items and are not meant to imply absolute orientation. For example, a third item can be disposed between the two items to which the above language refers.

Example embodiments of the claimed invention are directed to a well service rig system for tripping rods and tubulars. As used herein, "rods" and "tubulars" are not meant to limit the scope to a specific type of item referred to in the industry as a "rod" or a "tubular", but rather include a host of items that could be considered a rod or a tubular by the broadest sense of the word. For example a rod could include a sucker rod, but it may also include other items that could be classified as a rod by the broadest definition of the term "rod".

Example embodiments of the claimed intervention make reference to example processes such a pulling rods out of hole, running rods into hole, pulling tubulars out of hole, and running tubulars into hole. However, the techniques presented herein are also applied to other tripping processes used in the industry that may or may not involve rods or tubulars. Furthermore, the techniques presented herein also apply to processes not commonly known as tripping but which employ certain similar principles which can be effectively carried out by certain aspects of the present disclosure.

Figure 1:
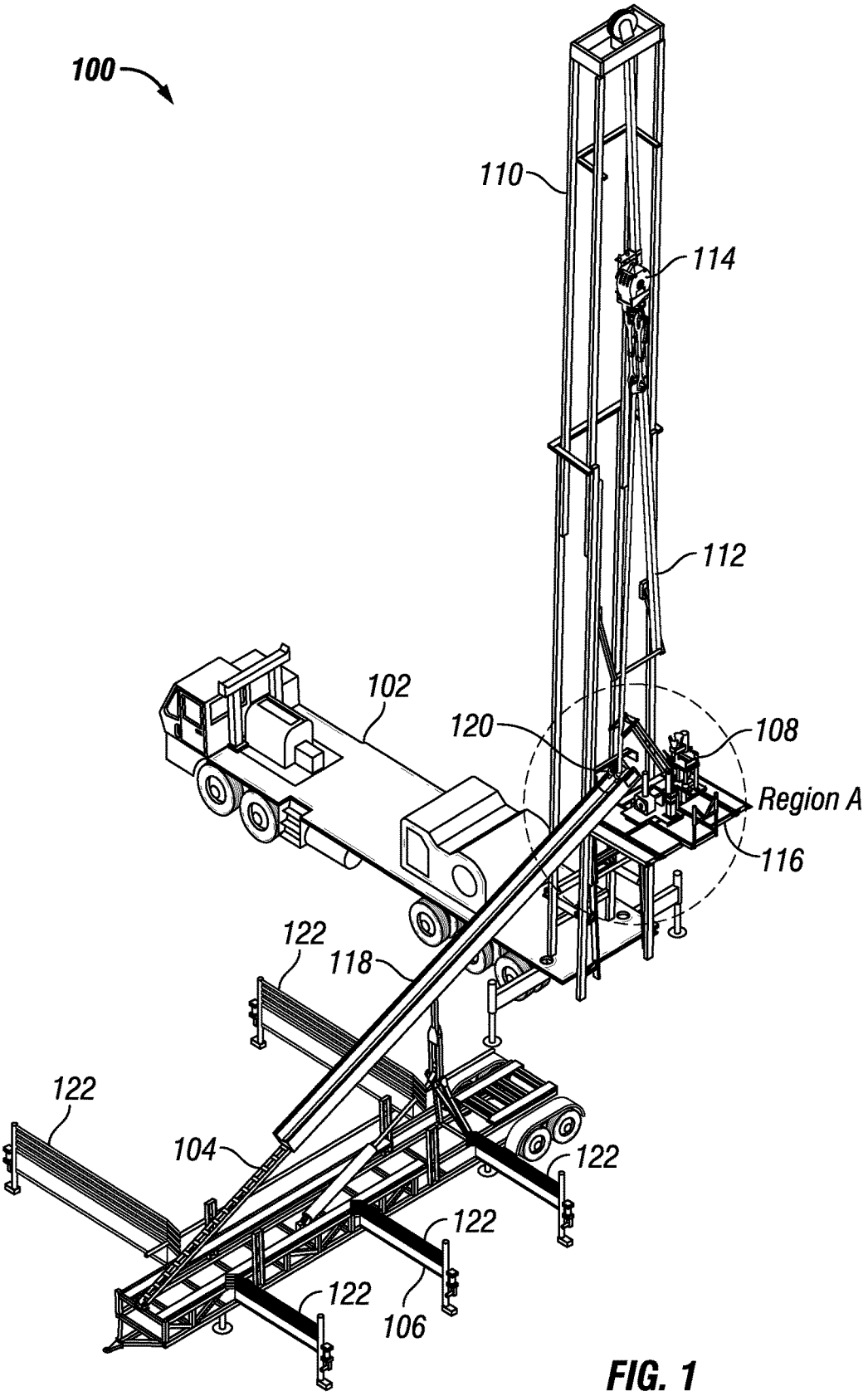
FIG. 1 illustrates a perspective view of a well service rig system, in accordance with certain example embodiments.
Figure 2:
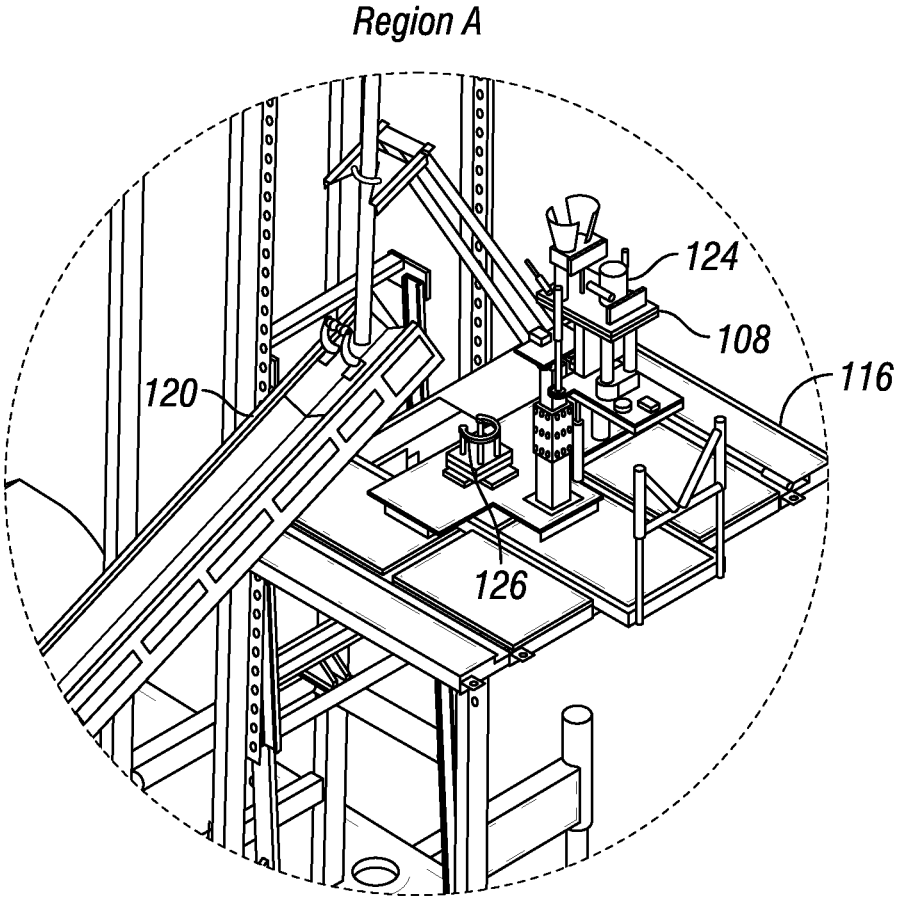
FIG. 2 illustrates a detailed view of a work floor of the well service rig system, in accordance with certain example embodiments.

Turning to the figures, FIG. 1 illustrates a well service rig system 100, in accordance with example embodiments of the present disclosure. FIG. 2 illustrates a detailed view of region A of FIG. 1. Referring to FIGS. 1 and 2, the well service rig system 100 includes a well service rig 102, a catwalk 104, a racking system 106, and a tong system 108. Among other components, the well service rig 102 includes a mast 110, a vertical guide 112, a traveling block system 114, and a work floor 116. The traveling block system 114 is configured to pick up and lower or raise a rod or tubular. In certain example embodiments, the vertical guide 112 hangs from the mast 110 and the traveling block system travels up and down the vertical guide 112 as it lowers or raises a rod or tubular. In certain example embodiments, the work floor 116 is coupled to the mast 110 and provides a work surface for operators or other equipment, if needed.

Among other components, the catwalk 104 includes a carriage 118 which can be raised from a horizontal position to a sloped and telescoped position. FIG. 1 illustrates the carriage 118 in the sloped and telescoped position. The carriage 118 is configured to deliver or receive a rod or tubular between the racking system 106 and the traveling block system 114. When the carriage is in the sloped position and telescoped, the carriage 118 is extended and the first end 120 of the carriage 118 is raised and reaches towards the work floor 116. For example, in a pulling out of hole (POH) operation, in the sloped and telescoped position, the carriage 118 is ready to receive a rod or tubular from the traveling block system 114. After the rod or tubular is placed onto the carriage 118, the carriage is lowered and retracted into the horizontal position and the rod or tubular is transferred to the racking system 106. In certain example embodiments, in a running into hole (RIH) operation, a rod or tubular is transferred from the racking system 106 to the carriage 118 in the horizontal position. The carriage 118 is then raised into the sloped position and extended into the telescoped position with the rod or tubular on board, and the traveling block system 114 picks up the rod or tubular from the first end 120 of the carriage 118.

Among other components, the racking system 106 includes a plurality of stackable beams 122. In a POH operation, the beams 122 support and store the rods or tubulars when the rods or tubulars are delivered from the carriage 118. In a RIH operation, the beams 122 deliver the rods or tubulars onto the carriage 118. In certain example embodiments, the beams 122 are layered and thus can support and store a plurality of layers of rods and tubulars. In certain example embodiments, and as illustrated in FIG. 1, the beams 122 are coupled to either side of the catwalk 104.

Among other components, the tong system 108 includes a tong assembly 124 and at least one string gripping device 126. In the embodiment illustrated in FIG. 2, the string gripping device 126 is a tubing slip configured to hold a tubular string for at least a portion of the time. In other example embodiments, the tubing slip is replaced with a rod clamp (FIG. 22) configured to hold a rod string. In the present disclosure, string gripping device 126 refers to either a tubing slip or a rod clamp, or other functionally similar devices. The tong assembly 124 is configured to unthread a first rod or tubular of a rod or tubular string from the rest of the rod or tubular string. For example, in a POH operation for sucker rods, the traveling block system 104 pulls a sucker rod string to a distance above ground such that a first sucker rod of the sucker rod string is completely above ground. The tong system 108 engages the junction between the first sucker rod and the rest of the sucker rod string. The string gripping device 126 holds onto the rest of the sucker rod string while the tong assembly 124 unthreads the first sucker rod from the rest of the sucker rod string. After the first sucker rod is separated from the rest of the sucker rod string, the first sucker rod is supported by and suspended from the traveling block system, and the rest of the sucker rod string is supported by the string gripping device 126. The first sucker rod is then placed on the carriage 104 in the sloped position and delivered to the racking system 106 for storage. In certain example embodiments, the well service rig system 100 is configured to perform a plurality of tripping services, including but not limited to POH and RIH operations, for a plurality of rod and tubular types. The components of the well service rig system 100 and their functions and interactions, further embodiments, as well as other example methods of use, will be discussed in further detail in this disclosure.

Figure 3A:
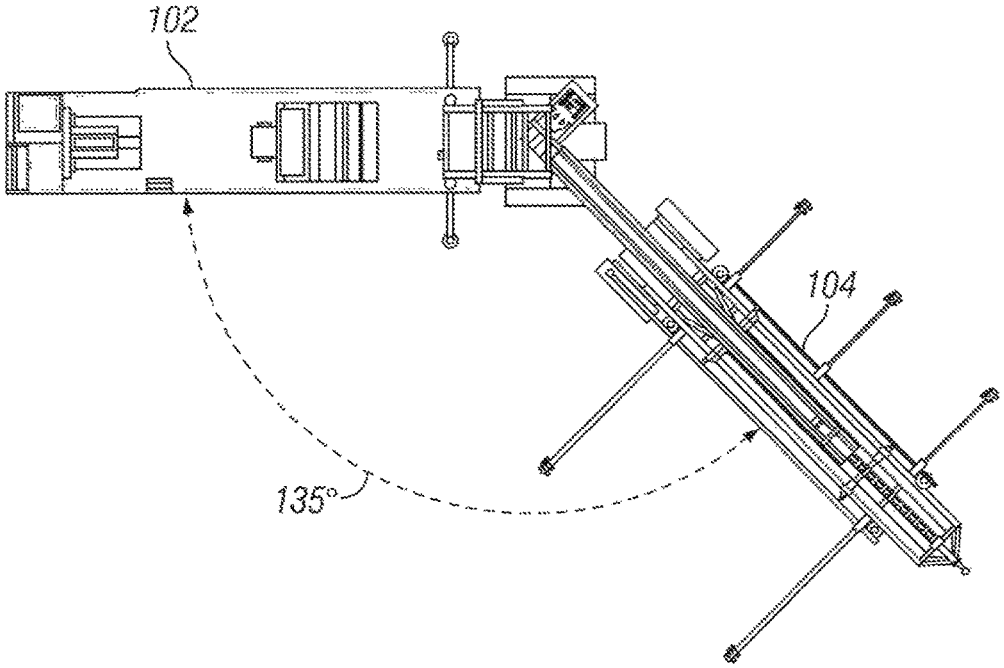
FIG. 3*a* illustrates a top view of the well service rig system in a 135° orientation, in accordance with certain example embodiments.
Figure 3B:
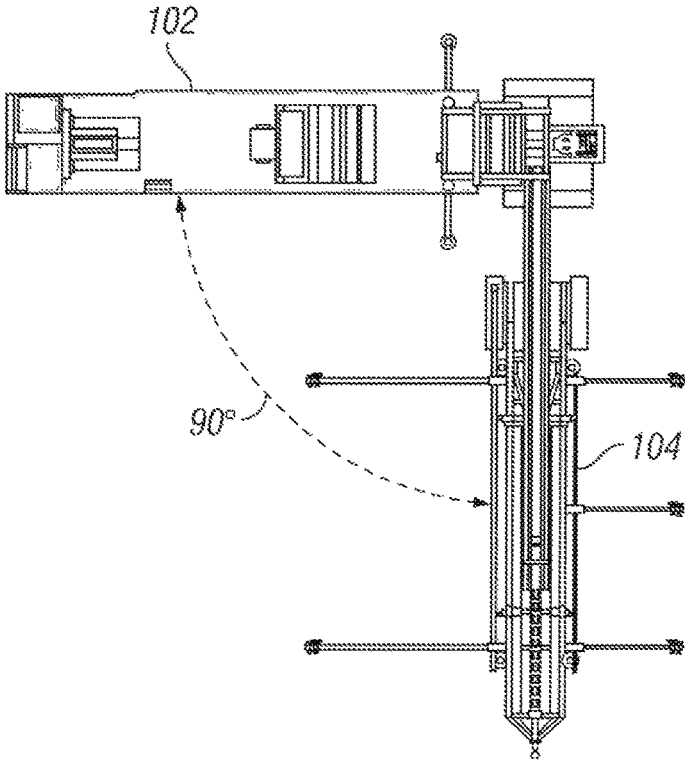
FIG. 3*b* illustrates a top view of the well service rig system in a 90° orientation, in accordance with certain example embodiments, in accordance with certain example embodiments.

In certain example embodiments, the configuration or arrangement of the well service rig system 100 is adaptable to fit the needs of the field and/or well. FIGS. 3*a* and 3*b* illustrate two example arrangements of the catwalk 104 in relation to the well service rig 102, in accordance to example embodiments of the disclosure. Referring to FIG. 3*a*, in certain example embodiments, the catwalk 104 is placed at a 135° angle with respect to the well service rig 102. Referring to FIG. 3*b*, in certain example embodiments, the catwalk 104 is placed at a 90° angle with respect to the well service rig 102. In certain example embodiments, the catwalk 104 can be placed at any angle with respect to the well service rig 102. Placement of the catwalk 104 with respect to the well service rig 102 can depend on various factors, such as space limitation, placement of other equipment, or preference. In certain example embodiments, one or more of these components are replaced with a different component or removed from the well service rig system 100.

Figure 4:
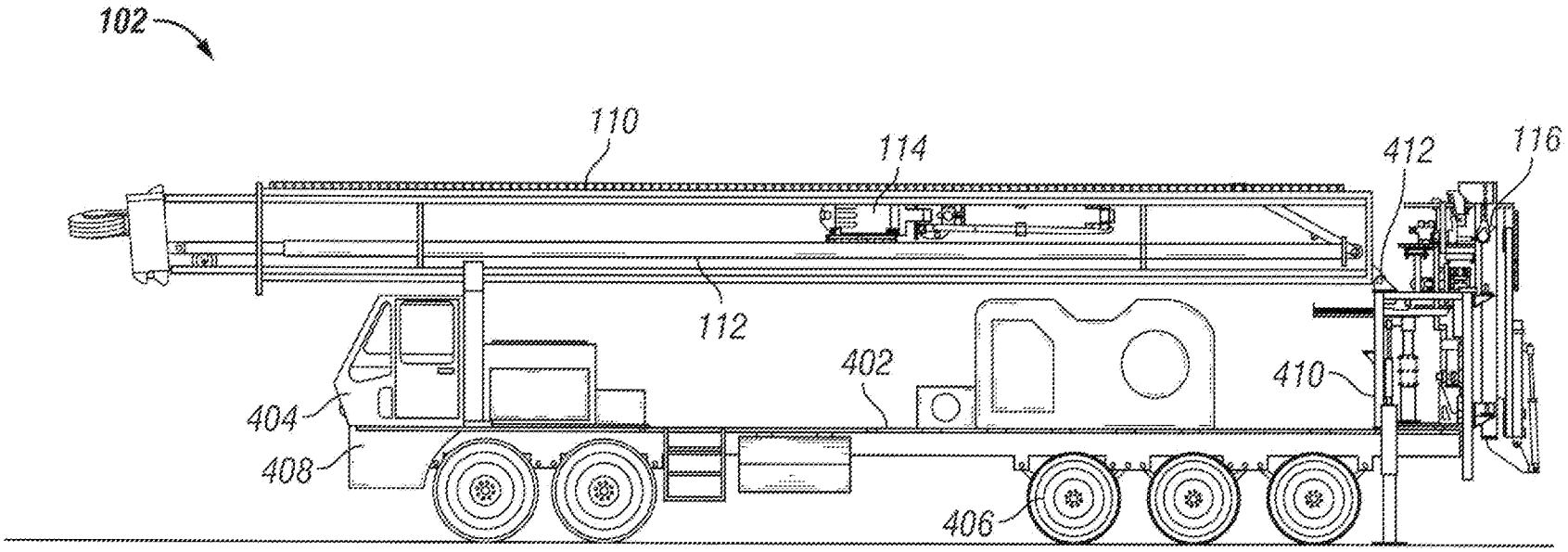
FIG. 4 illustrates a side view the well service rig in a folded or transport position, in accordance with certain example embodiments.

Each of the well service rig 102, the catwalk 104, the racking system 106, and the tong system 108 will now be described in detail. FIG. 4 illustrates a side view the well service rig 102 in a folded or transport position, in accordance with example embodiments of the present disclosure. Referring to FIG. 4, in addition to the mast 110, the vertical guide 112, the traveling block system 114, and the work floor 116, the well service rig 102 further includes a base unit 402 which provides a support for and houses the mast 110 and work floor 116. In certain example embodiments, and as illustrated in FIG. 4, the base unit 402 is a transport vehicle 404, and comprises a plurality of wheels 406. In such an embodiment, the well service rig 102 is independently mobile and can be driven to and from the work site when in the folded or transport position. In certain other example embodiments, the base unit 402 of the well service rig 102 is a skid rather than a vehicle. The base unit 402 includes a first end 408 and a second end 410. The mast 110 is coupled to the second end 410 of the base unit 402 via a hinge 412 or functionally hinging device. Thus the mast 110 is movable from the folded position into a raised position (FIGS. 5*a*-6*b*) via the hinge. In the folded position, the mast 110 is in a horizontal position oriented along the base unit 402. The work floor 116 is likewise folded onto the base unit 402. The well service rig 102 is transportable in the folded position.

Figure 5A:
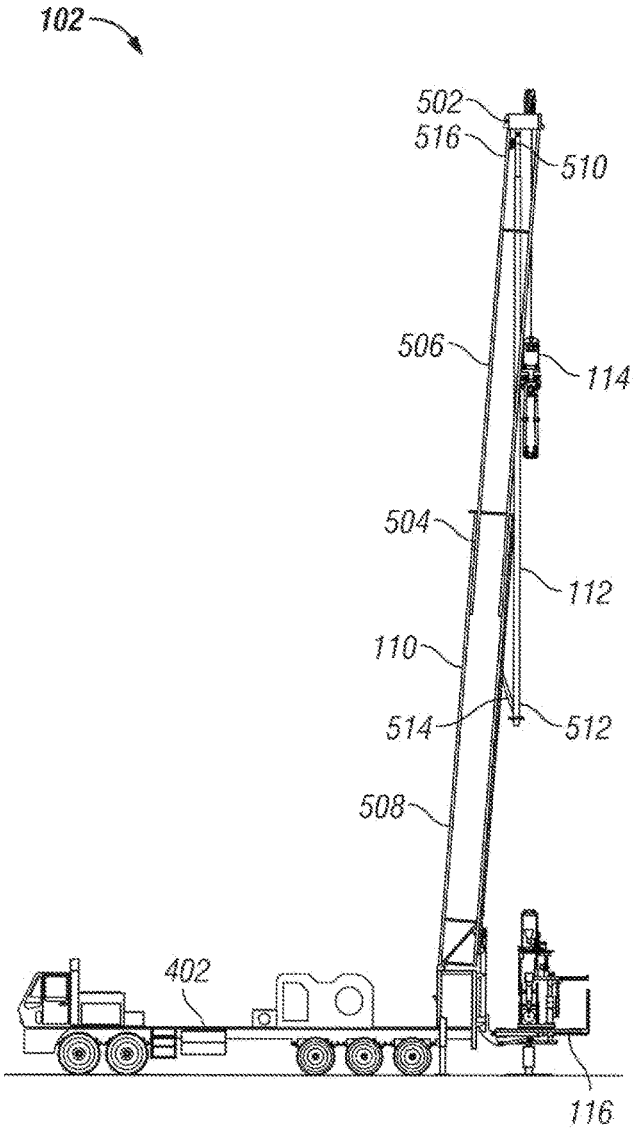
FIG. 5*a* illustrates a side view of the well service rig in a raised position with the work floor in a base position, in accordance with certain example embodiments.
Figure 5B:
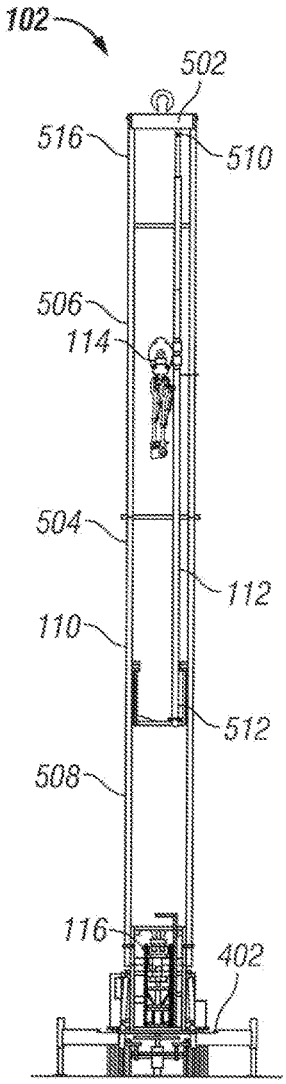
FIG. 5*b* illustrates a rear view of the well service rig in the raised position with the work floor in the base position, in accordance with certain example embodiments.

FIG. 5*a* illustrates a side view of the well service rig 102 in a raised position with the work floor 116 in a base position, in accordance with example embodiments of the present disclosure. FIG. 5*b* illustrates a rear view of the well service rig 102 in the raised position with the work floor 116 in the base position, in accordance with example embodiments of the present disclosure. Referring to FIGS. 5*a* and 5*b*, in the raised position, the mast 110 of the well service rig 102 is unfolded from the base unit 402 via the hinge 412 such that the mast 110 stands vertically from the second end 404 of the well service rig 102. In certain example embodiments, the mast 110 stands at an angle offset to the vertical, as illustrated in FIG. 5*a*. In certain example embodiment, the vertical is defined as being perpendicular to the ground or parallel to the direction of the well hole. For example, in one or more embodiments, the mast 110 is offset to the vertical by 4.5°. In certain other examples, the mast 110 is offset to the vertical by more or less than 4.5°, depending on the field and well properties, space limitations, mast certification, etc. In certain example embodiments, the mast 110 is parallel to the vertical.

The mast 110 includes a top end 502 which is the highest portion of the mast 110. In certain example embodiments, the mast 110 has an adjustable (i.e., telescoping) height. In such an embodiment, the mast 110 includes a base portion 508 and an extendable portion 506. The base portion 508 and the extendable portion 506 are coupled by a brace 504 or mechanical lock, which keeps the extended portion stable and aligned with the base portion 508. Accordingly, the mast 110 can be configured into an extended position and a retracted position. In the extended position, the extendable portion 506 extends from the base portion 508 and adds to the height of the base portion 508. In the retracted position, the extendable portion 506 is retracted within the base portion 508. The mast 110 is in the retracted position when the well service rig 102 is in the transport position, as shown in FIG. 4, and extended when the well service rig 102 is in the operating position. In certain other example embodiments, the mast 110 is a non-telescoping single height structure. The offset of the mast 110 to the vertical allows the well rig 102 to be parked to the side of a well hole and the top end 502 of the mast to be directly over the well hole. However, in certain other example embodiments, the mast is disposed vertically without an offset.

In certain example embodiments, the vertical guide 112 is coupled to and supported by the mast 110. The vertical guide 112 includes a top end 510 and a bottom end 512. In certain example embodiments, the top end 510 of the vertical guide 112 is coupled to the top end 502 of the mast 110. In certain example embodiments, the top end 510 of the vertical guide 112 is coupled to the top end 502 of the mast 110 via a hinge 516. In certain other example embodiments, the vertical guide 112 is coupled to the mast 110 via another coupling mechanism 512 which provides a certain amount of angular motion between the vertical guide 112 and the mast 110. In certain example embodiments, the vertical guide 112 is further coupled to the mast 110 at the bottom end 512 of the vertical guide 112. In certain such embodiments, the bottom end 512 of the vertical guide 112 is coupled to the mast 110 via an extension bar 514. The extension bar 514 is rotatively coupled to the mast at one end and rotatively coupled to the vertical guide 112 at another end, and holds the bottom end 512 of the vertical guide 112 in place relative to the mast. Thus, the extension bar 514 provides both stability as well a range of motion for the vertical guide 112 with respect to the mast 110. In certain other embodiments, the extension bar 514 is coupled to the vertical guide 112 at a point between the top end 510 and the bottom end 512. In certain embodiments, the extension bar is removed or replaced with a different component which likewise provides stability as well as a range of motion for the vertical guide 112. In certain example embodiments, the vertical guide 112 is adjustable with respect to the mast 110, with the coupling of the top end 510 of the vertical guide 112 and the top end 502 of the mast 110 being the axis of rotation, and the length of the extension bar 514 defining a maximum offset between the vertical guide 112 and the mast 110. In certain example embodiments, the vertical guide 112 is parallel to the vertical and parallel with a rod or tubular string in a well. In certain example embodiments, the vertical guide 112 is a shaft. The vertical guide can also be tubular, square, another generally linear configuration. In certain example embodiments, the vertical guide 112 is also telescoping and has an adjustable length. In certain example embodiments, the vertical guide 112 is folded into the mast 110 when the well service rig is in the transport position, as shown in FIG. 4.

The traveling block system 114 is coupled to the vertical guide 112. In certain example embodiments, the traveling block system 114 is coupled to the vertical guide 112 via a releasable coupling mechanism such as a quick release mechanism, such that the traveling block system 114 can be easily coupled to and decoupled from the vertical guide 112. The traveling block system 114 is configured to travel up and down the vertical guide 112. In certain example embodiments, the traveling block system 114 travels at least a portion of the length of the vertical guide 112. The traveling block system 114 can travel more or less of a portion of the vertical guide 112 depending on the motion needed for the operation as well as the configuration of the vertical guide 112. The traveling block system 114 is configured to pick up, raise, and/or lower one or more rods or tubulars. For example, in a POH operation, the traveling block system 114 is configured to pick up and raise the first rod or tubular of a rod or tubular string from the well, and then lower the first rod or tubular onto the carriage 118 of the catwalk 104. In a RIH operation, the traveling block system 114 is configured to pick up and raise a rod or tubular from the carriage 118 and lower the rod or tubular onto a rod or tubular string, and then lower the rod or tubular string further down-hole. Thus, the traveling block system 114 is to be aligned with the rod or tubular string over the course of travel. The vertical guide 112 provides such an aligned path of travel for the traveling block system 114. The traveling block system 114 is discussed in further detail below with respect to FIGS. 8*a*-9*b*.

Figure 6A:
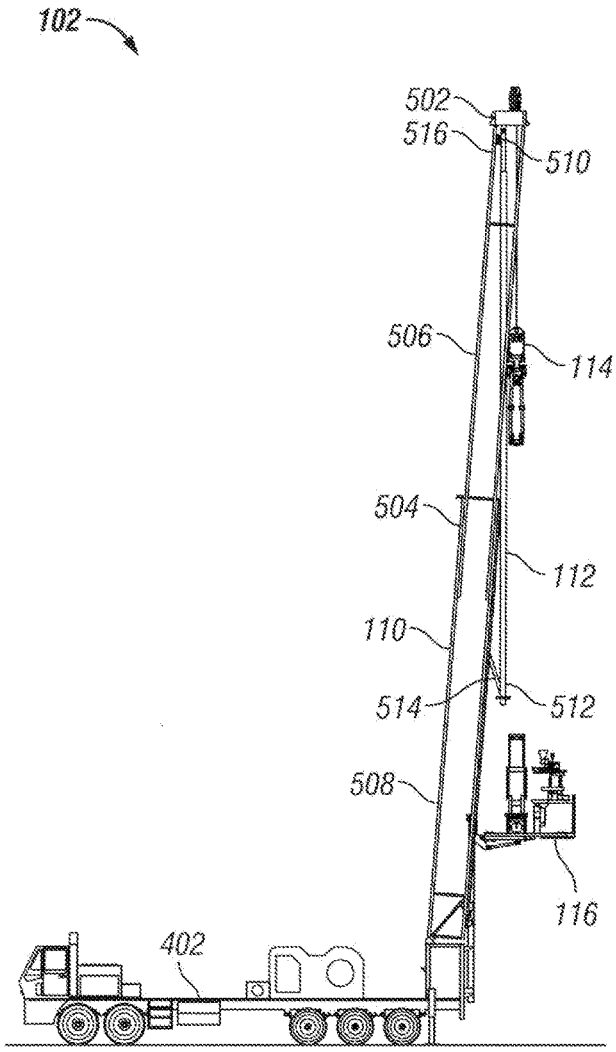
FIG. 6*a* illustrates a side view of the well service rig in a raised position with the work floor at raised height, in accordance with certain example embodiments.
Figure 6B:
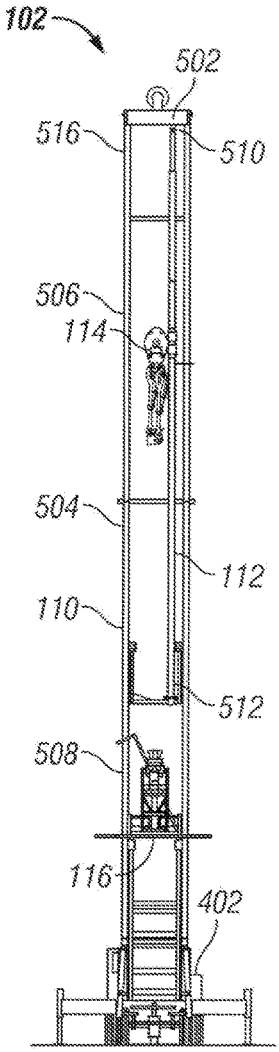
FIG. 6*b* illustrates a rear view of the well service rig in the raised position with the work floor at a raised height, in accordance with certain example embodiments.
Figure 7:
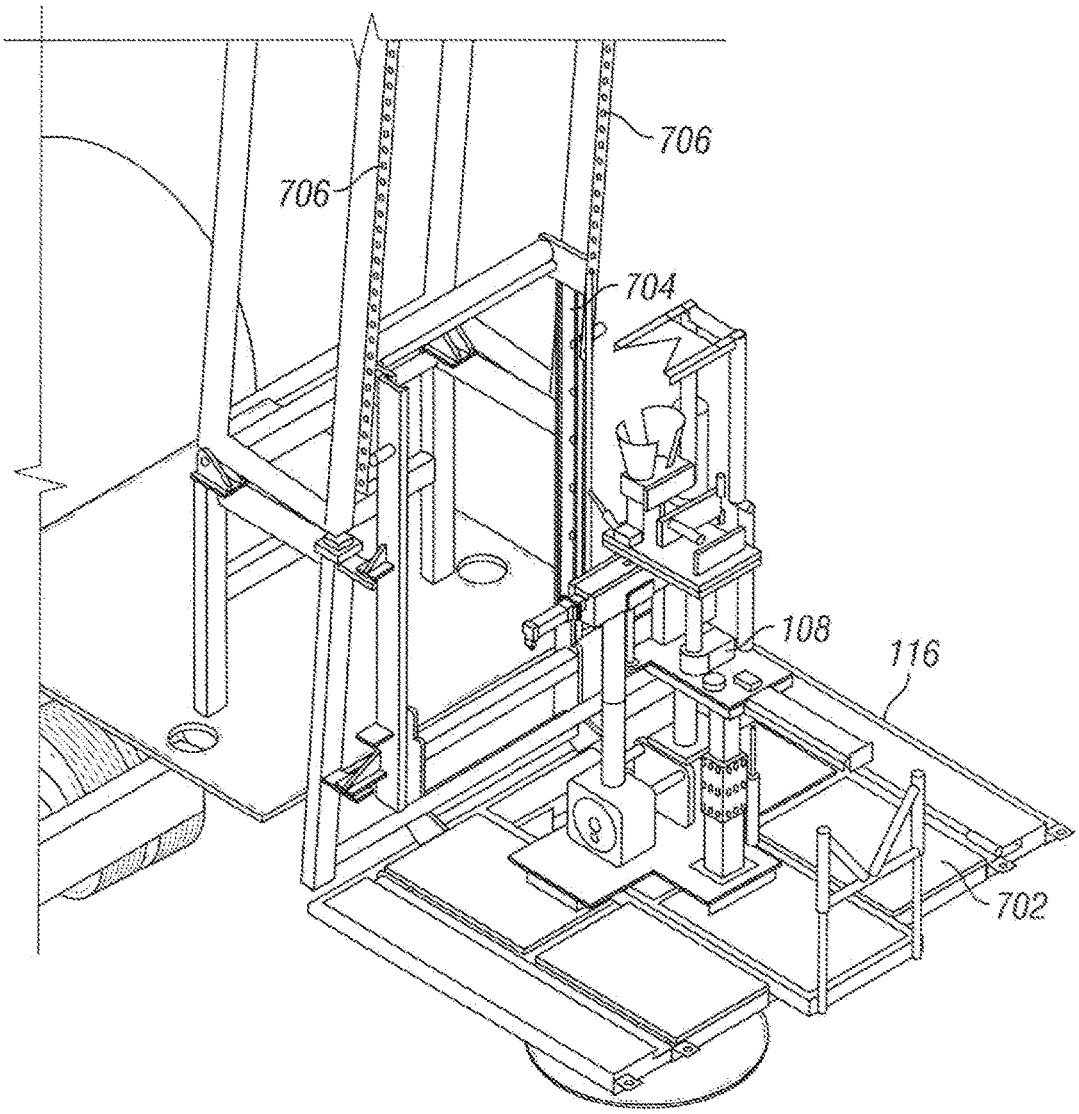
FIG. 7 illustrates a detailed perspective view of the work floor, in accordance with certain example embodiments.

In certain example embodiments, the work floor 116 of the well service rig 102 can be adjusted from a base height to a variable second height. FIGS. 5*a* and 5*b* show the work floor 116 at the base height. FIGS. 6*a* and 6*b* illustrate the well service rig 102 with the work floor 116 raised to a second height. In certain example embodiments, the base height of the work floor 116 is 4 feet from the ground and second height of the work floor 116 is 20 feet from the ground. In certain other embodiments, the base height is lower than 4 feet, and in certain example embodiments, the second height is between 4 feet and 20 feet, or greater than 20 feet. The height or position of the work floor 116 is typically chosen based on the height of the wellhead and other accessories. FIG. 7 illustrates a detailed perspective view of the work floor 116, shown here at the base height, in accordance with example embodiments of the present disclosure. Referring to FIG. 7, the work floor 116 includes a surface 702 for supporting an operator or other equipment. The work floor 116 further includes an opening (not shown) through which the tong system 108 can be coupled to a wellhead and/or accessories. It should be noted that in certain example embodiments, the tong system 108 is attached and supported from the wellhead and/or accessories rather than from the work floor 116. In certain example embodiments, the work floor 116 is suspended from the mast 110 via a bracket 704. Furthermore, the base portion 508 of the unit 102 includes a mounting 706 which includes a column of receivers for coupling the work floor 116 to the mast 110 at different heights along a portion of the mast 110, thereby providing a range of heights for the work floor 116.

Figure 8A:
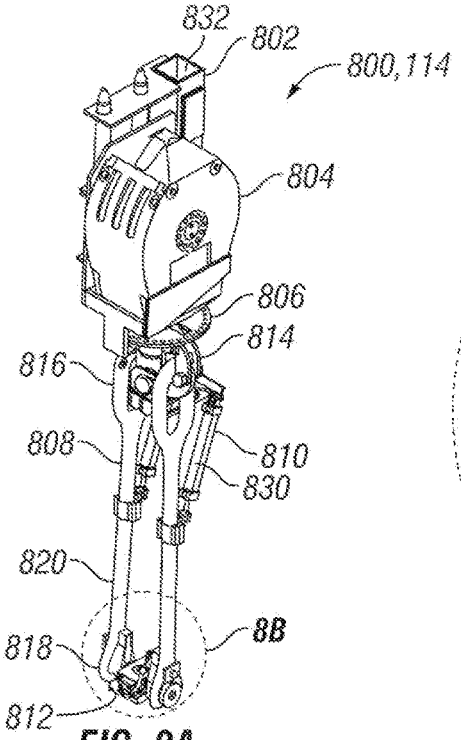
FIG. 8*a* illustrates a rod servicing traveling block system, in accordance with certain example embodiments.
Figure 8B:
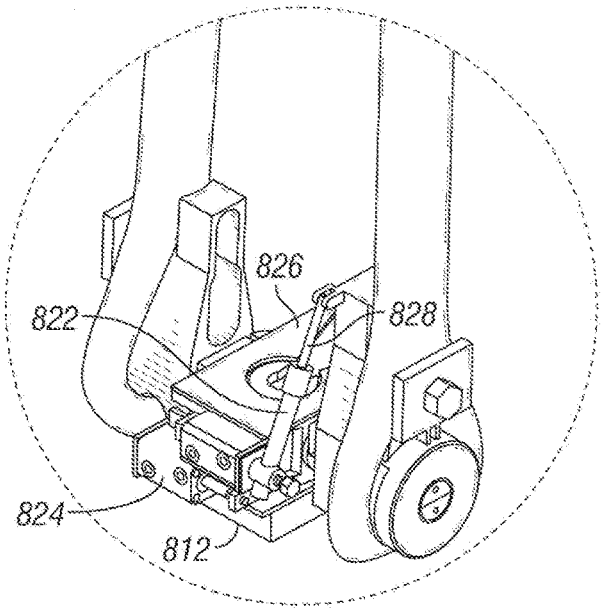
FIG. 8*b* illustrates a detailed view of detail 8*b* of FIG. 8, in accordance with certain example embodiments.

FIG. 8*a* illustrates one example embodiment of the traveling block system 114 in a rod servicing configuration, in accordance with example embodiments of the present disclosure. Specifically, FIG. 8*a* illustrates a rod servicing traveling block system 800. FIG. 8*b* illustrates a detailed view of detail 8*b* of FIG. 8*a*, in accordance with example embodiments of the present disclosure. Referring to FIGS. 8*a* and 8*b*, the traveling block system 800 includes a guide assembly 802, a block body 804, a rotation dial 806, one or more links 808, a link tilt actuator 810, and a rod elevator 812. The guide assembly 802 couples the traveling block system 114 to the vertical guide 112 and travels up and down the vertical guide 112. In certain example embodiments, the guide assembly 802 includes a guide grip 832, which is disposed around the vertical guide 112. In certain example embodiments, the guide assembly 802 includes a quick release mechanism and can be easily coupled to and decoupled from the vertical guide 112. The guide assembly 802 is coupled to the block body 804. The block body 804 drives the traveling block system 114 up and down the vertical guide 112 and actuates other mechanized aspects of the traveling block system 114. In certain example embodiments, the rotation dial 806 is coupled under the drive block 804 and above the one or more links 808. In certain example embodiments, the rotation dial 806 can be rotated to change the orientation of the links 808 and therefore the orientation of the rod elevator 812. As discussed with reference to FIGS. 3*a* and 3*b*, the well service rig system 100 allows the catwalk 104 to be oriented at any angle with respect to the well service rig 102. As such, the traveling block system 800 may need to be able to pick up and deliver rods in a range of angles. The rotation dial 806 allows the links 808 and the rod elevator 812 to be rotated to the appropriate angle for picking up and delivering rods according to the given angle of the catwalk 104 with respect to the well service rig 102. In certain example embodiment, the rotation dial 806 includes a plurality of holes which can be pinned to stabilize the rotation dial 806 in the desired position. In an example embodiment, the rotation dial 806 is positionable in 36 rotational positions.

In certain example embodiments, the links 808 and the link tilt actuator 810 are coupled to the rotation disk 806 opposite the block body 804 via a link holder 814. The rotation disk 806, the links 808, the link tilt actuator 810, and the link holder 814 are jointly known as a link tilt system. In certain example embodiments, and as shown in FIG. 8*a*, the traveling block system 800 includes a pair of links 808. Each of the links 808 includes an block connector 816 disposed at one end and an elevator connector 818 disposed at an opposite end, and a shaft 820 in between. The block connector 816 couples the links 808 to the link holder 814 with a degree of swinging or tilting motion. Specifically, in certain example embodiments, the block connectors 816 of the links 808 are linked with the link holder 814 such that the links 808 can tilt in the same direction with respect to the link holder 814.

Each link 808 is coupled to one of the link tilt actuators 810. The link tilt actuators 810 are coupled to the link holder 814 at one end and coupled to the shaft 820 of the respective link 808 at the opposite end. In certain example embodiments, the link tilt actuators 810 are configured to control tilting of the links 808 by lifting or pushing the links 808. In certain example embodiments, the link tilt actuators 810 each include an extender 830. The extenders 830 allow the link tilt actuators 810 to extend in length and push the links 808. Thus, in such example embodiments, when the extenders 830 are in a neutral position, the links 808 are in a neutral position as well, hanging from the link holder 814. The links 808 are tilted or pushed when the extenders 830 are in an extended position. For example, in a RIH operation, the traveling block system 800 is configured to pick up a rod from the carriage 118. When the rod is in the carriage 118, the rod is at an angle to the traveling block system 800 and disposed at a distance away from the traveling block system. Thus, in order to align the rod elevator 812 with the rod and reach the rod, the link tilt actuators 810 push the links 808 toward the rod to place the rod elevator 812 at an appropriate angle and distance to reach and grip the rod. In another example, such as in an POH operation, the traveling block system 800 is configured to pick up a rod of a rod string positioned directly below the traveling block system (i.e., in the wellhole). The rod elevator 812 can grip the rod while in the neutral position.

The elevator connectors 818 are coupled to the rod elevator 812. Specifically, the rod elevator 812 is coupled to and in between the elevator connectors 818 of the two links 808. In certain example embodiments, the rod elevator 812 is rotatively coupled in between the elevator connectors 818 such that the rod elevator 812 can tilt with respect to the links 808. In certain example embodiments, the rod elevator 812 includes a tiling cylinder 822, which actuates the tilting of the rod elevator 812. In certain example embodiments, the rod elevator 812 is configured to couple to an end of a rod, allowing the traveling block system 800 to lift the rod. In certain example embodiments, the rod elevator 812 includes a clamp 826 having a middle orifice 828. In such embodiments, the rod elevator 812 opens to dispose the clamp 826 around the end of a rod and closes to retain the rod within the middle orifice 828. The clamp 826 then opens to release the rod. In certain example embodiments, the rod elevator 812 includes an open/close cylinder, which actuates opening and closing of the clamp 826.

The traveling block system 800 in conjunction with the rod elevator 812 is able to pick up a rod from a rod string and deliver the rod onto a sloped carriage 118 in a POH operation. Specifically, in a POH operation, the links 808 and the rod elevator 812 are in the neutral position when lifting a first rod of a rod string up and out of the well hole. After the tong system 108 unthreads the first rod from the rod string, the bottom end of the first rod is pushed at an angle onto the carriage 118, in which the first rod is now at an angle. Accordingly, the rod elevator, which is still gripping the first rod, tilts with respect to the links 808 to accommodate the angle of the first rod. As the traveling block system 800 lowers the first rod further onto the carriage 118, the angle of the first rod to the vertical increases. Thus, the tilting angle of the rod elevator 812 increases accordingly. As the first rod is almost completely disposed on the carriage 118, the links 808 are push or tilted towards the carriage 118 by the link tilt actuators 810 such that the rod elevator 812 can reach the carriage, and is thereby able to place the first rod in its entirely onto the carriage 118. Conversely, in a RIH operation, the links 808 and rod elevator 812 are tilted in order to pick up a rod from the carriage and gradually return to the neutral position as the rod is raised and brought to a vertical position for coupling to a rod string.

Figure 9A:
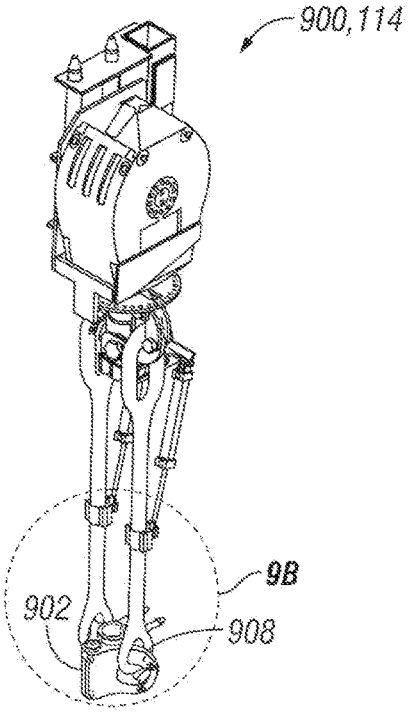
FIG. 9*a* illustrates a tubular servicing traveling block system, in accordance with certain example embodiments.
Figure 9B:
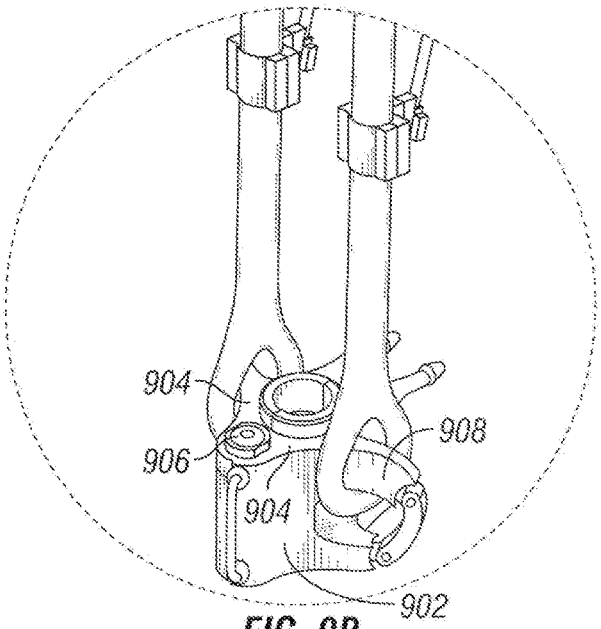
FIG. 9*b* illustrates a detailed view of detail 9*b* of FIG. 9, in accordance with certain example embodiments.

FIG. 9*a* illustrates one example embodiment of the traveling block system 114 in a tubular servicing configuration, in accordance with example embodiments of the present disclosure. Specifically, FIG. 9*a* illustrates a tubular servicing traveling block system 900. FIG. 9*b* illustrates a detailed view of detail 9*b* of FIG. 9*a*, in accordance with example embodiments of the present disclosure. Referring to FIGS. 9*a* and 9*b*, the traveling block system 900 includes the guide assembly 802, the block body 804, the rotation dial 806, the one or more links 808, and the link tilt actuator 810 of the traveling block system 800 of FIG. 8*a*. However, the tubular servicing traveling block system includes a tubular elevator 902 rather and the rod elevator 812. In certain example embodiments, the guide assembly 802, the block body 804, the rotation dial 806, the one or more links 808, and the link tilt actuator 810 of the traveling block system 900 are similar to that described above with reference to FIG. 8*a*. Thus, such elements are not repeated for sake of brevity. However, the rod elevator 812 of FIG. 8*a* is replaced with the tubular elevator 902. The tubular elevator 902 includes a clamp having two parts 904 coupled by a hinge 906. Each part 904 of the clamp includes a linking portion 908 coupled to the links 808. In certain example embodiments, the linking portions 908 and the elevator connectors 818 are linked together such that the tubular elevator 902 maintains a certain range of motion with respect to the elevator connectors 818 while being retained by the elevator connectors 818. Thus, the tubular elevator 902 is able to tilt accordingly when picking up a tubular from the carriage 118 or placing a tubular onto the carriage 118.

Figure 10:
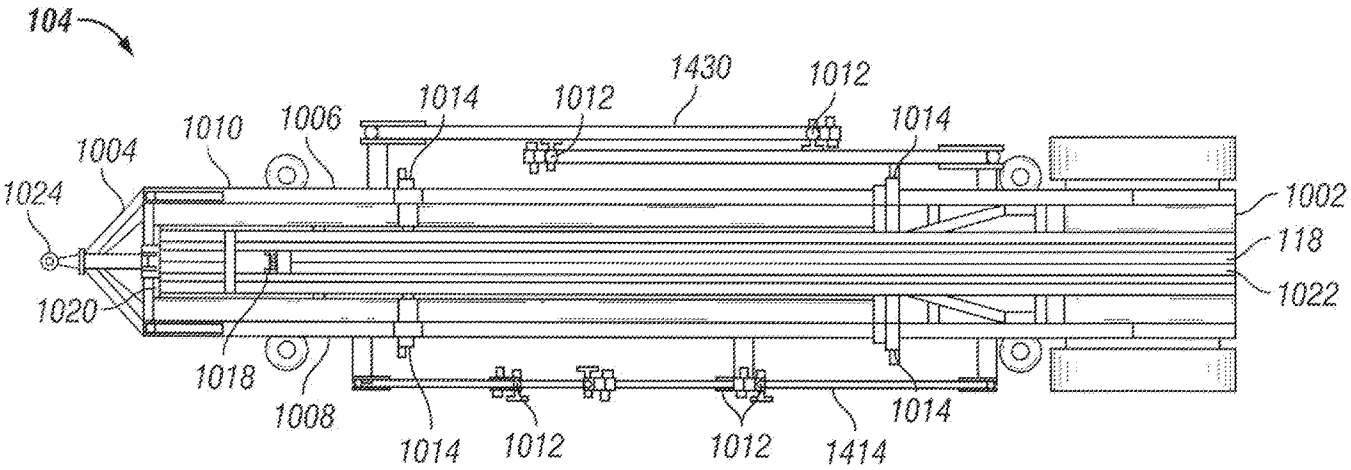
FIG. 10 illustrates a top view of a catwalk in a horizontal position, in accordance with certain example embodiments.
Figure 11:
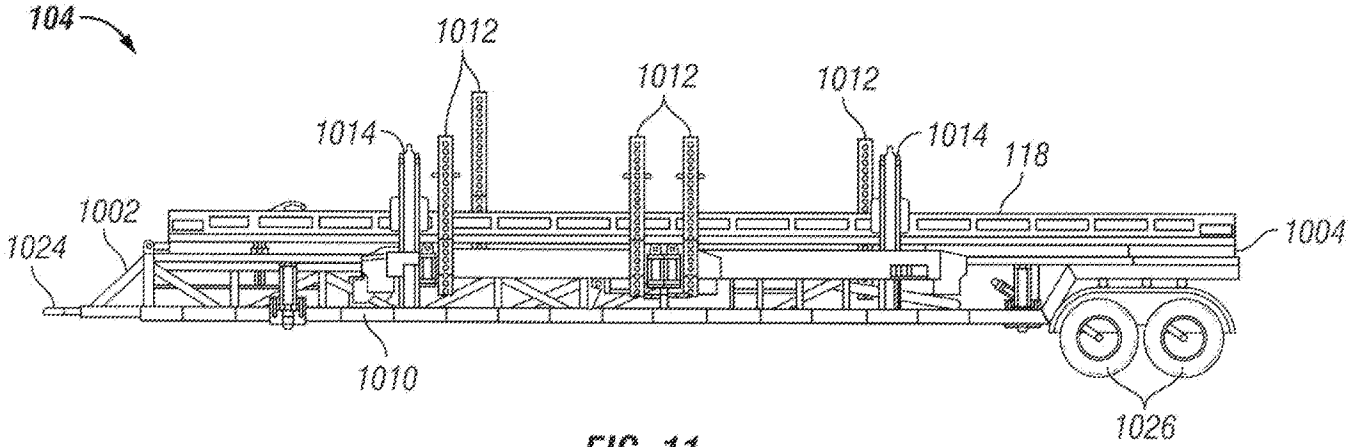
FIG. 11 illustrates a side view of the catwalk in the horizontal position, in accordance with certain example embodiments.

FIG. 10 illustrates a top view of a catwalk in a horizontal position, in accordance with certain example embodiments of the present disclosure. FIG. 11 illustrates a side view of the catwalk in the horizontal position, in accordance with certain example embodiments. FIGS. 10 and 11 further illustrate the racking system folded along the sides of the catwalk 102, in accordance with example embodiments. Referring to FIGS. 10 and 11, the catwalk 102 includes a base 1010 and the carriage 118. The base 1010 further includes a front end 1002, a rear end 1004 opposite the front end, a first side 1006, and a second side 1008 opposite the first side, in which the first and second sides 1006, 1008 extend from the front end 1002 to the rear end 1004. A distance between the front end 1002 and the rear end 1004 defines a length of the base 1010, and a distance between the first side 1006 and the second side 1008 defines a width of the base 1010. In the horizontal position, the carriage 118 is disposed along the length of the base 1010 and parallel to the sides 1006, 1008 of the base 1010. The carriage 118 includes a first end 1020 and a second end 1022. In certain example embodiments, the first end 1020 of the carriage 118 lays adjacent to the front end 1002 of the base 1010 and the second end 1022 lays adjacent to the rear end 1004 of the base 1010 when the carriage 118 is in the horizontal position. A distance between the first end 1020 and the second end 1022 of the carriage 118 defines the length of the carriage 118. Specifically, the carriage 118 spans a majority of the length of the base 1010 and the length of the carriage 118 is parallel to the length of the base 1010.

Figure 12:
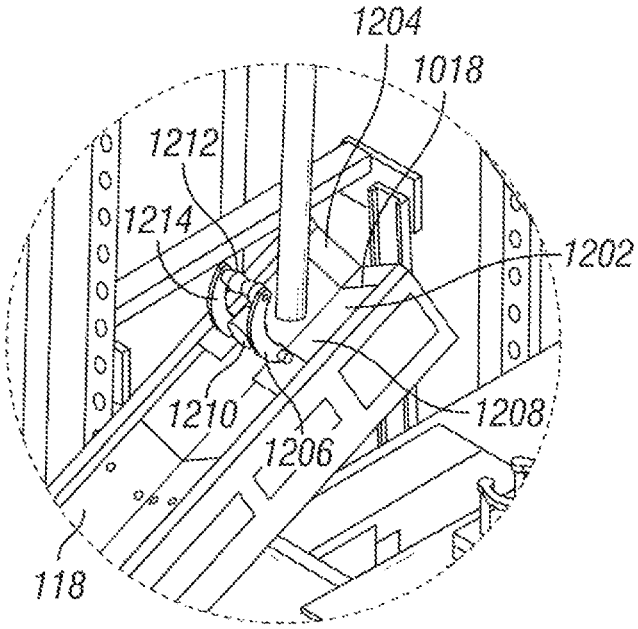
FIG. 12 illustrates a detailed view of a skate, in accordance with example embodiments.

In certain example embodiments, the carriage 118 further includes a skate 1018. The skate 1018 is configured to travel at least a portion of the length of the carriage 118. The skate 1018 helps to guide a rod or tubular onto the carriage 118 or off of the carriage 118. A detailed view of the skate is illustrated in FIG. 12. Referring to FIG. 12, in certain example embodiments, the skate 1018 includes a trough 1202 and a holder clamp 1210. The trough 1202 includes a top end 1204, a bottom end 1206, and a surface 1208 extending from the top end 1204 to the bottom end 1206. In one example embodiment, the surface 1208 of the trough 1202 is capable of handling rods while causing minimal to no damage to the rods, which tend to be more fragile than tubulars. In certain example embodiments, the surface 1208 is fabricated from a non-marking material. For example, in certain example embodiments, the surface 1208 of the trough 1202 is fabricated from a material such as a polymer.

In one example embodiment, the surface 1208 of the trough 1202 is fabricated from neoprene. The holder clamp 1210 is configured to clamp or stabilize an end of a rod or tubular onto the trough 1202. In certain example embodiments, the holder clamp 1210 includes a roller 1212 coupled to a clamp arm 1214, which is coupled to the bottom end 1206 of the trough 1202 by a hinge. The roller 1212 facilitates movement of clamp arm 1214 when a rod or tubular are in the trough 1202. In an example embodiment, the roller 1212 is fabricated from steel. In certain example embodiment, the holder clamp 1210 applies a limited force onto the rod or tubular towards the trough 1202, the force being limited to that which can be withstood by a rod (i.e., cause minimal to no damage to the rod). In certain example embodiments, the skate 1018 is driven in a first direction and a second direction opposite the first direction along the carriage 118 by a chain (not shown). In certain example embodiments, the holding clamp 1210 is pulled towards the trough 1202 when the skate 1018 is driven in the first direction and away from the trough 1202 when the skate 1018 is driven in the second direction. For example, in a POH operation, the skate 1018 is brought to the first end 1020 of the carriage 118, where the skate 1018 receives a rod or tubular by its bottom end, or the end of the rod or tubular opposite the traveling block system 114, onto the trough. The bottom end of the rod or tubular is positioned in the trough 1202, and stabilized and supported by the holder clamp 1010. The skate 1018 then travels down towards the second end 1022 of the carriage 118 along with the bottom end of the rod or tubular, and the rod or tubular is lowered onto the carriage 118. In a RIH operation, the skate 1018 travels from the second end 1022 of the carriage 118 to the first end 1020 of the carriage 118 and thereby guides a rod or tubular up and out of the carriage 118 as the rod or tubular is lifted by the traveling block system 114. In certain example embodiments, the skate 1018 is driven in a first direction and a second direction opposite the first direction along the carriage 118 by a chain, wherein the holding clamp 1210 is pulled towards the trough 1202 when the skate 1018 is driven in the first direction and away from the trough 1202 when the skate 1018 is driven in the second direction. In certain example embodiments, and as illustrated in FIG. 11, the base 1010 of the catwalk 104 is a trailer comprising a hitch 1024 and a plurality of wheels 1026, providing mobility to the catwalk 104. In certain other example embodiments, the base 1010 is a skid.

Figure 13:
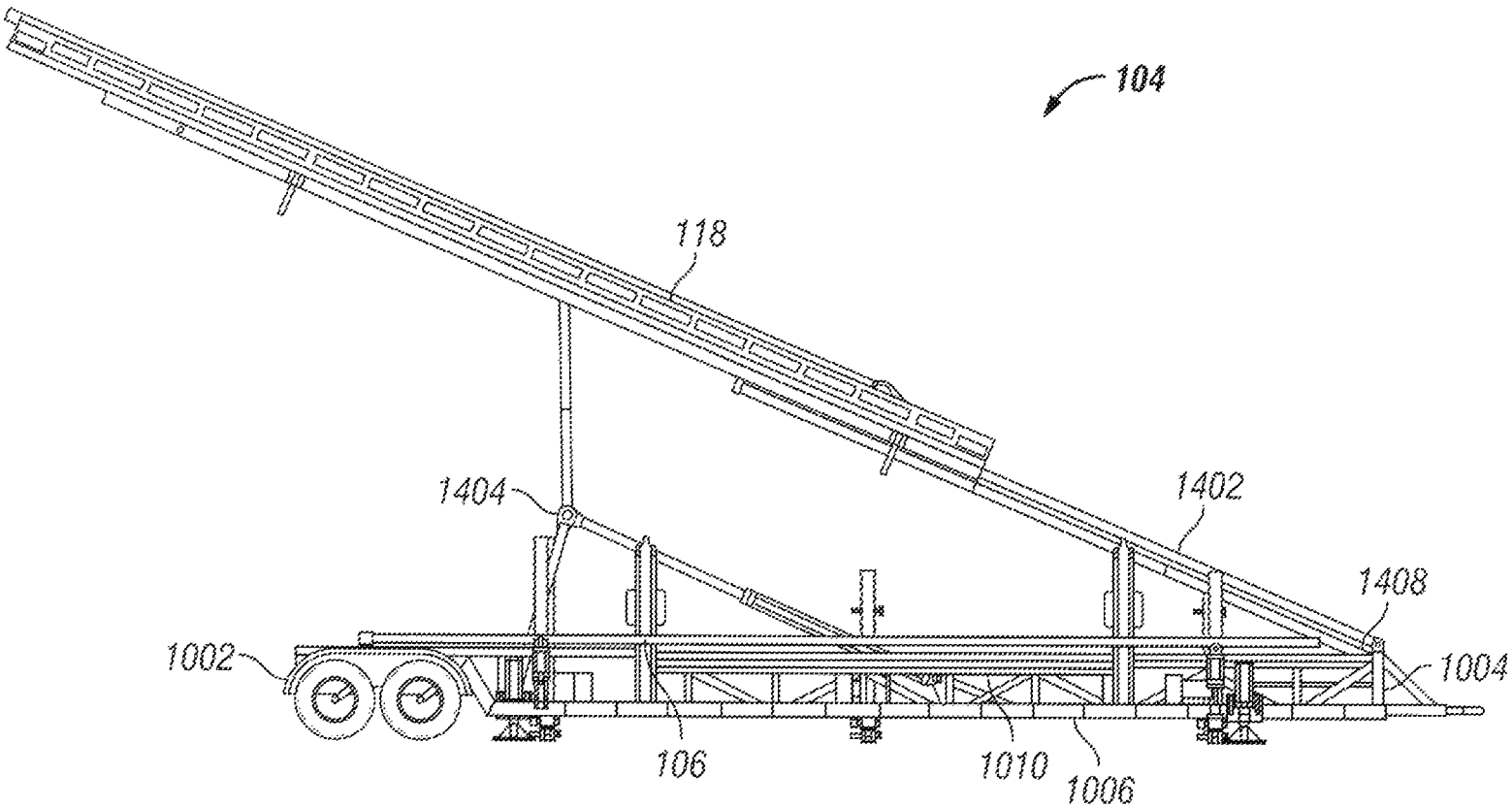
FIG. 13 illustrates a side view of the catwalk in a raised and extended position, in accordance with certain example embodiments.
Figure 14:
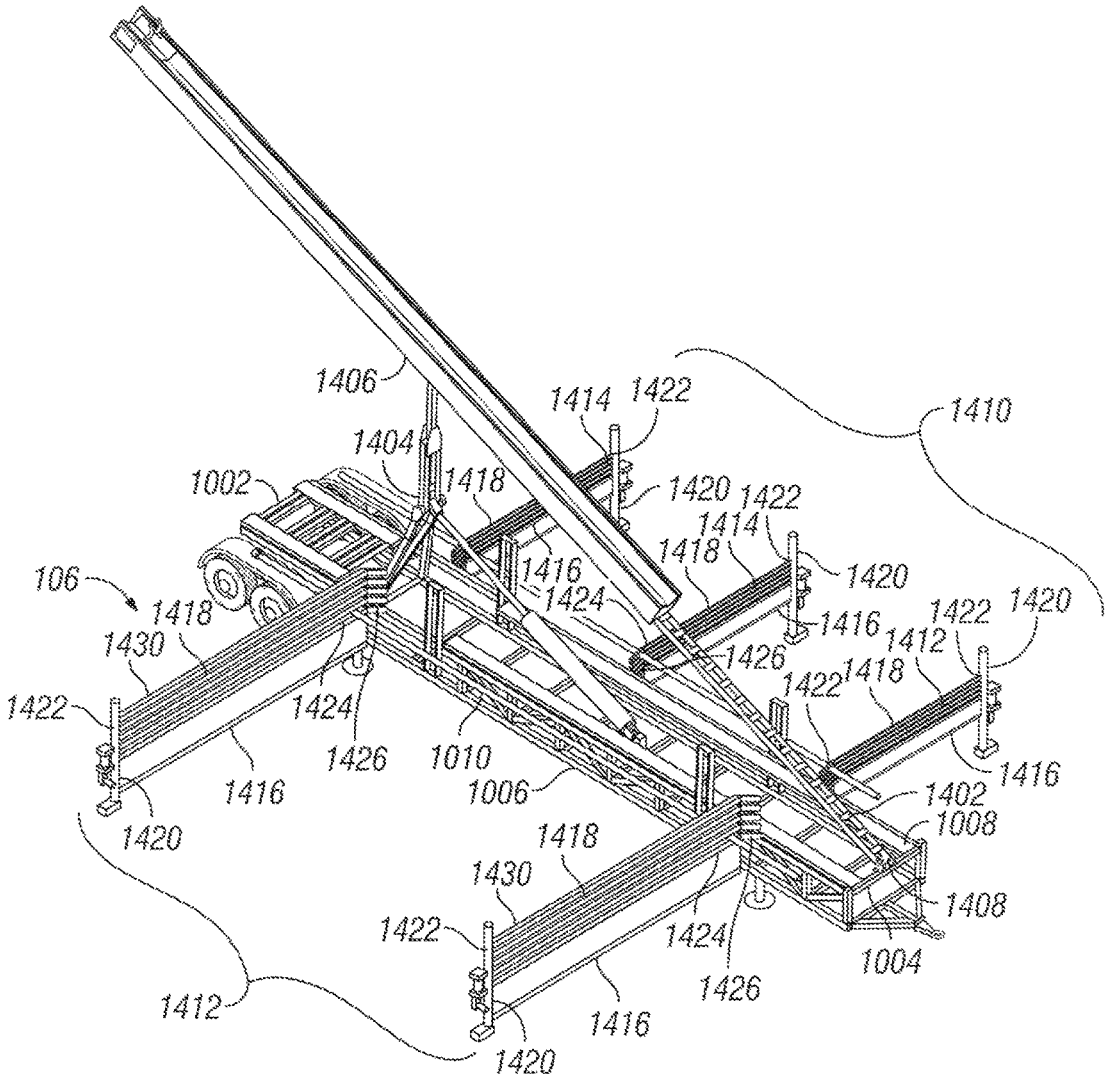
FIG. 14 illustrates a perspective view of the catwalk in a raised and extended position, in accordance with certain example embodiments.

FIG. 13 illustrates a side view of the catwalk 104 in a raised and extended position, in accordance with example embodiments of the present disclosure. FIG. 14 illustrates a perspective view of the catwalk 104 in a raised and telescoped position, in accordance with certain example embodiments. Referring to FIGS. 13 and 14, the carriage 118 is coupled to a carriage extension track 1402. The carriage extension track 1402 provides a means for the carriage 118 to slide forward and towards the well service rig 102 (FIG. 1) and the traveling block system 114 when delivering or receiving a rod or tubular. When the catwalk 104 is in the horizontal position (FIGS. 10 and 11), the carriage 118 is retracted onto the carriage extension track 1402. When the carriage 118 is in the sloped and telescoped position, the carriage 118 is able to slide up and down the carriage extension track 1402. In certain example embodiments, a coupling end 1408 of the carriage extension track 1402 is rotatively coupled to the second end 1002 of the base 1010 such that the coupling end 1408 remains coupled to the base 1010 as the carriage 118 is lifted upward, putting the carriage 118 and the carriage extension track 1402 into a sloped and telescoped position. In certain example embodiments, the raising jack 1404 lifts the carriage 118 and the carriage extension track 1402 into the sloped and telescoped position from the horizontal position. In certain example embodiments, the raising jack 1404 includes a lifting mechanism such as a hydraulic cylinder.

FIG. 14 further illustrates the racking system 106, in accordance with example embodiments of the present disclosure. Referring to FIG. 14, in certain example embodiments, the racking system 106 is coupled to the base 1010 of the catwalk 104. In certain example embodiments, the racking system 106 is a part of the catwalk 104. In certain other example embodiments, the racking system 106 is independent of the catwalk 104 and removably coupled to the catwalk during use. In certain example embodiments, the racking system 106 includes at least one rod rack 1410. In certain example embodiments, the rod rack 1410 is coupled to the first side 1006 of the base 1010 or the second side 1008 of the base 1010. In certain example embodiments, The racking system 106 includes two rod racks 1410. In such an example embodiment, one rod rack 1410 is coupled to the first side 1006 of the base 1010 and the other rod rack 1410 is coupled to the second side 1008 of the base 1010.

The rod rack 1410 includes a plurality of rod supports 1414 configured to collectively support a plurality of rods thereacross. For example, the illustrated rod rack 1410 includes three rod supports 1414. In certain other example embodiments, the rod rack 1410 includes more or less than three rod supports 1414. In certain example embodiments, each rod support 1414 includes a base beam 1416. In certain example embodiments, each rod support 1414 includes a base beam 1416 and one or more separator beams 1418 stacked above the base beam 1416 via one or more spacing pins or other spacing devices. In certain example embodiments, the base beams 1416 are configured to support and store a first layer of rods across the length of the base beams 1416. In certain example embodiments, each rod support 1414 includes a first separator beam 1418, the first separator beams 1418 collectively making up a first layer of separator beams 1418. The first layer of separator beams 1418 is configured to support and store a second layer of rods above the first layer of rods stored on the base beams 1416. In certain example embodiments, the rod support includes a second layer of separator beams 1418 coupled to the first layer of separator beams 1418 via spacing pins, and configured to support and store a third layer of rods. In certain example embodiments, the rod rack 1410 includes two rod supports 1414 configured to collectively support a plurality of rods thereacross.

In certain example embodiments, the rod supports 1414 include additional layers of separator beams 1418 configured to support and store additional layers of rods. In certain example embodiments, such as in a POH operation, in which rods are taken out of hole and delivered to the rod rack 1410, additional layers of separator beams 1418 are added when the previous layer is filled to capacity with rods. Conversely, in a RIH operation, in which rods are delivered from the rod rack 1410 to be brought down-hole, a layer of separator beams 1418 is removed when all the rods supported by that layer have been delivered, so that the layer of rods below said layer of separator beams 1418 can be accessed. In certain example embodiments, each rod support 1414 further includes a proximal end 1422 and a distal end 1424, with the proximal end 1422 adjacent to the base 1010 of the catwalk 104 and the distal end 1424 opposite the proximal end 1422. The length of the rod supports 1414, the base beams 1416, and the separator beams 1418 are defined as the distance between the proximal end 1422 and the distal end 1424. In certain example embodiments, each rod support 1414 further comprises an end jack 1420 coupled to the distal end 1422. The end jacks 1420 are respectively coupled to the base beams 1416 and are configured to raise and/or lower the base beams 1416 by the distal end 1424 while the proximal ends 1422 remain at the same height, thereby placing the rod support 1414 at either an upward sloping angle with respect to the proximal end 1422, a downward sloping angle with respect to the proximal end 1422, or at the same height as the proximal end 1422.

In certain example embodiments, each of the separator beams 1418 is coupled to a ramp 1426 at the proximal end 1422. In certain example embodiments, the ramp 1426 is adjustable via a raising a lowering mechanism on the separator beams 1418. In certain example embodiments, all the of ramps 1426 are adjusted together as one. Specifically, in such embodiments, the ramp 1426 can be configured to slope upward from the respective separator beam 1418 towards the unit 1010 or to slope downward from the respective separator beam 1418 towards the unit 1010. In certain example embodiments, the ramps 1426 facilitate delivery of rods from the rod rack 1410 onto the carriage 118 when the ramps 1426 slope down from the beams towards the carriage. Conversely, the ramps 1426 facilitate delivery of rods from the carriage 118 onto the rod rack 1410 when the ramps 1426 slope down from the carriage towards to the beams. Thus, the angle of the ramps 1426 can be adjusted depending on the desired operation (e.g., POH, RIH).

In certain example embodiments, the racking system 106 includes at least one tubular rack 1412. Similar to the rod rack 1410, the tubular rack 1412 includes a plurality of tubular supports 1428 configured to collectively support a plurality of tubulars thereacross. For example, the illustrated tubular rack 1412 includes two tubular supports 1430. In certain other example embodiments, the tubular rack 1412 includes more than two tubular supports 1430. In certain example embodiments, each tubular support 1430 includes a base beam 1416. In certain example embodiments, each tubular support 1430 includes a base beam 1416 and one or more separator beams 1418 stacked above the base beam 1416 via one or more spacing pins or other spacing devices. In certain example embodiments, the base beams 1416 of the tubular supports 1430 are configured to support and store a first layer of tubulars across the length of the base beams 1416. In certain example embodiments, each tubular support 1430 includes a first separator beam 1418, the first separator beams 1418 collectively making up a first layer of separator beams 1418. The first layer of separator beams 1418 of the tubular support 1430 is configured to support and store a second layer of tubulars above the first layer tubulars stored on the base beams 1416. In certain example embodiments, the rod support includes a second layer of separator beams 1418 coupled to the first layer of separator beams 1418 via spacing pins, and configured to support and store a third layer of rods. In certain example embodiments, the tubular rack 1412 includes two tubular supports configured to collectively support a plurality of tubulars there across.

In certain example embodiments, the tubular support 1430 include additional layers of separator beams 1418 configured to support and store additional layers of tubulars. In certain example embodiments, such as in a POH operation, in which tubulars are taken out of hole and delivered to the tubular rack 1412, additional layers of separator beams 1418 are added when the previous layer is filled to capacity with tubular. Conversely, in a RIH operation, in which tubulars are delivered from the tubular rack 1412 to be brought down-hole, a layer of separator beams 1418 are removed when all the tubulars supported by that layer have been delivered, so that the layer of tubulars below said layer of separator beams 1418 can be accessed.

In certain example embodiments, each tubular support 1430 further includes a proximal end 1422 and a distal end 1424, with the proximal end 1422 adjacent to the base 1010 of the catwalk 104 and the distal end 1424 opposite the proximal end 1422. The lengths of the tubular support 1430, the base beams 1416, and the separator beams 1418 are defined as the distance between the proximal end 1422 and the distal end 1424. In certain example embodiments, each tubular support 1430 further comprises an end jack 1420 coupled to the distal end 1422. The end jacks 1420 are respectively coupled to the base beams 1416 and are configured to raise and/or lower the base beams 1416 by the distal end 1424 while the proximal ends 1422 remain at the same height, thereby placing the tubular support 1430 at either an upward sloping angle with respect to the proximal end 1422, a downward sloping angle with respect to the proximal end 1422, or at the same height as the proximal end 1422.

In certain example embodiments, each of the separator beams 1418 is coupled to a ramp 1426 at the proximal end 1422. In certain example embodiments, the ramp 1426 is adjustable. Specifically, in such embodiments, the ramp 1426 can be configured to slope upward from the respective separator beam 1418 or base beam 1416 towards the unit 1010 or to slope downward from the respective separator beam 1418 or base beam 1416 towards the unit 1010. In certain example embodiments, the ramps 1426 facilitate delivery of tubulars from the tubular rack 1412 onto the carriage 118 when the ramps 1426 slope down from the beams towards the carriage. Conversely, the ramps 1426 facilitate delivery of rods from the carriage 118 onto the tubular rack 1412 when the ramps 1426 slope down from the carriage towards to the beams. Thus, the angle of the ramps 1426 can be adjusted depending on the desired operation (e.g., POH, RIH). In certain example embodiments, the racking system 106 further includes one or more rotating indexers interfacing between the racking system 106 and the catwalk 104. The indexers provide a means of transporting rods and/or tubular between the racking system 106 and the catwalk 104. The indexers are described in further detail below and with reference to FIGS. 15 and 16.

In certain example embodiments, the racking system 106 includes two tubular racks 1412, one disposed on each side of the catwalk 104. In certain other example embodiments, the racking system 106 includes one tubular rack 1412 and one rock rack 1210, as illustrated in FIG. 14. In one such embodiment, the tubular rack 1412 is disposed at the first side 1006 of the unit 1010 and the rod rack 1410 is disposed at the second side 1008 of the unit 1010, or vice versa. The racking system 106 is shown in FIG. 14 in an extended position ready for use. In certain example embodiments, the racking system 106 can be stowed on the catwalk 104, as illustrated in FIG. 10. Specifically, referring to FIG. 10, the rod supports 1414 and/or tubular supports 1430 of the racking system 106 are folded onto the first side 1006 and/or second side 1008 of the catwalk unit 1010. The catwalk 104 and racking system 106 are transportable in such a configuration.

Figure 15:
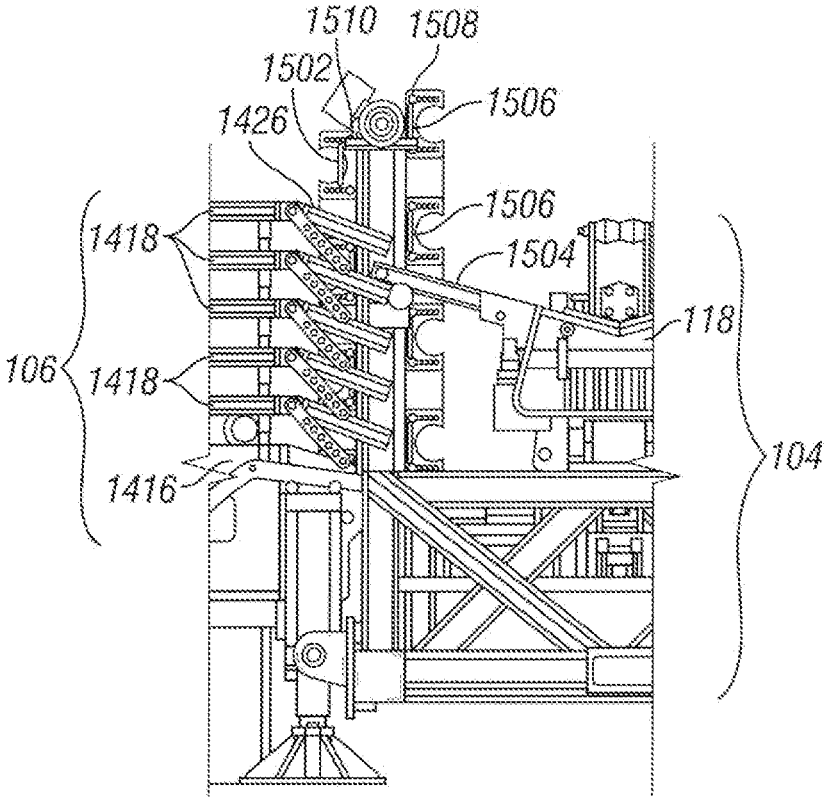
FIG. 15 illustrates an interaction between a racking system and the catwalk during a running into hole operation, in accordance with certain example embodiments.
Figure 16:
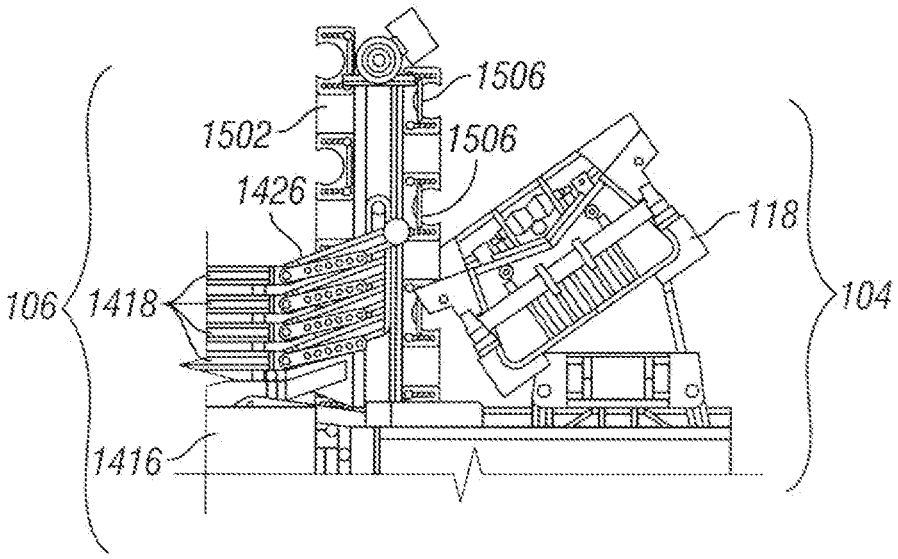
FIG. 16 illustrates the interaction between the racking system and the catwalk during a pulling out of hole operation, in accordance with certain example embodiments.

FIGS. 15 and 16 illustrate detailed views of the junction of the racking system 106 and the catwalk 104, in accordance with example embodiments of the present disclosure. Specifically, FIG. 15 illustrates the interaction between the racking system 106 and the catwalk 104 during a RIH operation, in accordance with example embodiments. FIG. 16 illustrates the interaction between the racking system 106 and the catwalk 104 during a POH operation, in accordance with example embodiments. Referring to FIGS. 15 and 16, and as mentioned above, the racking system 106 includes one or more rotating indexers 1502 disposed between the racking system 106 and the catwalk 104, and configured to transport rods or tubulars between the racking system 106 and the catwalk 104. Specifically, the rotating indexer 1502 includes a first side 1508 and a second side 1510, and one or more holders 1506 disposed around the indexer 1502 and facing outward. The holders 1506 include a cavity in which a rod or tubular can be held. In certain example embodiments, the first side 1508 of the indexer 1502 faces the catwalk 104 and the second side 1510 of the indexer 1502 faces the racking system 106. In certain example embodiments, when the indexer 1502 rotates, the holders 1506 rotate from the first side 1508 of the indexer 1502 to the second side 1510 of the indexer, or vice versa. Thus, the holders 1506 travel from facing the catwalk 104 and the carriage 118 to facing the racking system 106, or vice versa, when the indexer 1502 rotates.

In a RIH operation, as illustrated in FIG. 15, a rod or tubular is delivered from the racking system 106 onto the catwalk 104. During such a mode of use, a rod or tubular is from one of the separator beams 1418 or the base beam 1416 and onto the respective ramp 1426. The downward slope of the ramp 1426 disposes the rod or tubular against the rotating indexer 1502. When one of the holders 1506 rotates past the rod or tubular, the rod or tubular becomes disposed within the cavity of the holder 1506. Thus, the rod or tubular is picked up by the holder 1506 and rotates with holder 1506 from the second side 1510 of the indexer 1502 to the first side 1508 of the indexer 1502. In certain example embodiments, during a RIH operation, the indexer 1502 rotates clockwise with respect to the perspective of FIG. 15, such that the rod or tubular is carried over the top of the indexer rather than the bottom. As the holder 1506 travels down the first side 1508 of the indexer 1502, the holder 1506 eventually passes a carriage ramp 1504 sloping down towards the carriage 118. As the holder 1506 passes the carriage ramp 1504, the rod or tubular onboard the holder 1506 hits the carriage ramp 1504 and discharges from the holder 1506 onto the carriage ramp 1504. The rod or tubular then rolls down the carriage ramp 1504 and into the carriage 118.

In a POH operation, as illustrated in FIG. 16, a rod or tubular is delivered from the catwalk 104 into the racking system 106. During such a mode of use, the carriage 118 of the catwalk 104, which has a rod or tubular onboard, tilts towards the indexer 1502 while the carriage 118 is in the horizontal position. The rod or tubular thus rolls towards the indexer 1502 until is it is disposed against the indexer 1502. When one of the holders 1506 rotates past the rod or tubular, the rod or tubular becomes disposed within the cavity of the holder 1506. Thus, the rod or tubular is picked up by the holder 1506 and rotates with holder 1506 from the first side 1508 of the indexer 1502 to the second side 1510 of the indexer 1502. In certain example embodiments, during a POH operation, the indexer 1502 rotates counter-clockwise with respect to the perspective of FIG. 16, such that the rod or tubular is carried over the top of the indexer 1502 rather than the bottom. As the holder 1506 travels down the second side 1510 of the indexer 1502, it eventually passes one of the ramps 1426 of the racking system 106. As the holder 1506 passes the ramp 1426, the rod or tubular onboard the holder 1506 hits the ramp 1426 and discharges from the holder 1506 onto the ramp 1426. In such an operation, the ramps 1426 slope down from the indexer towards the separator beams 1418. Thus, the rod or tubular then rolls down the ramp 1426 and onto the separator beams 1418 or the base beam 1416.

Figure 19:
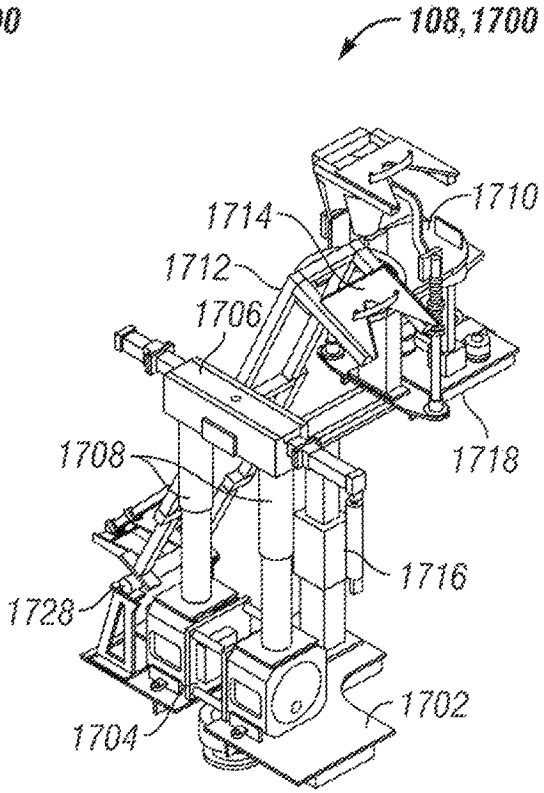
FIG. 19 illustrates the rod tong system in a transfer position, in accordance with certain example embodiments.
Figure 18:
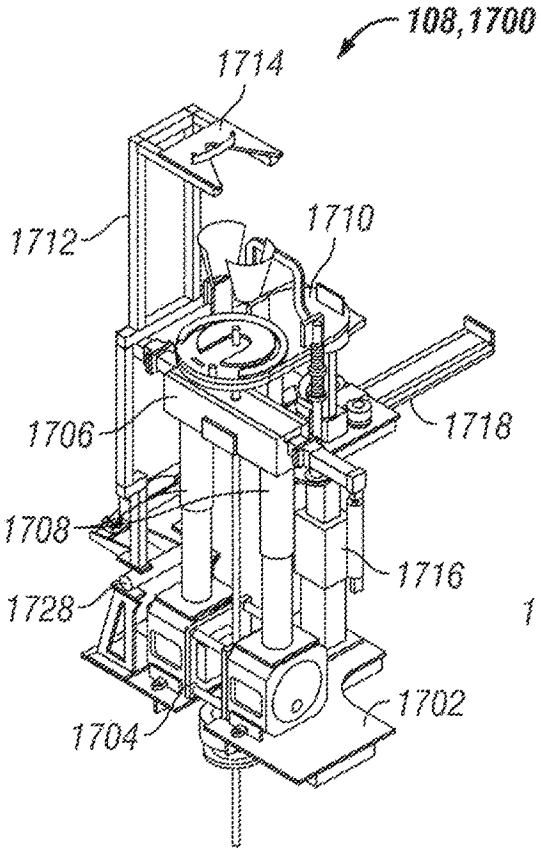
FIG. 18 illustrates the rod tong system in an engaged position, in accordance with certain example embodiments.
Figure 17:
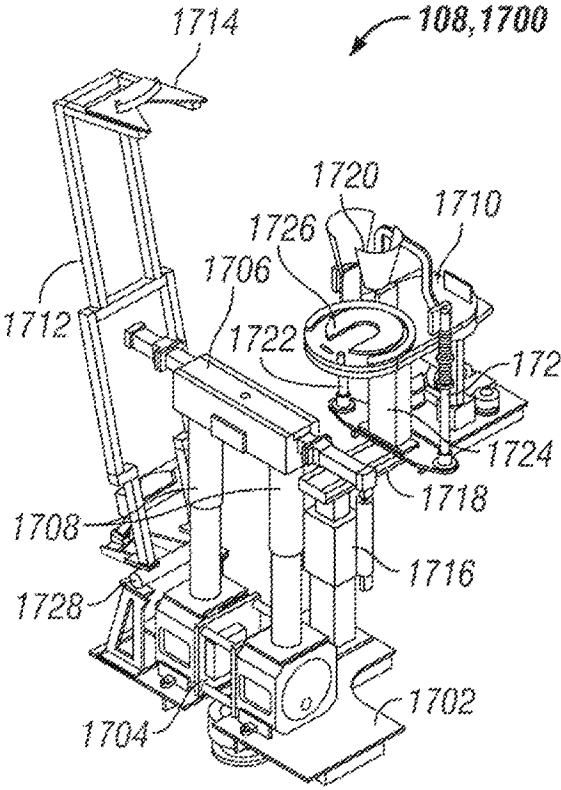
FIG. 17 illustrates a rod tong system in a disengaged position, in accordance with certain example embodiments.

FIGS. 17, 18, and 19 illustrate the tong system 108 in three positions, in accordance with example embodiments of the present disclosure. Specifically, FIGS. 17, 18, and 19 illustrates a rod tong system 1700. FIG. 17 illustrates the rod tong system 1700 in a disengaged position, FIG. 18 illustrates the rod tong system 1700 in an engaged position, and FIG. 19 illustrates the rod tong system 1700 in a reach position, in accordance with example embodiments. In certain example embodiments, such as in a POH operation, the rod tong system 1700 is configured for a rod string being pulled out of hole and disassemble the rods of the rod string for transport to the catwalk 104 and ultimately to the racking system 106. Conversely, in a RIH operation, the rod tong system 1700 is configured to assembly additional rods onto the rod string so that they can lower the rod string further down-hole. Referring to FIGS. 17, 18, and 19, the rod tong system 1700 includes a base 1702, a rod clamp 1704, a rod positioner assembly 1706, a tong assembly 1710, and a centralizer arm 1712.

In certain example embodiments, the rod clamp 1704 is disposed on the base 1702. The rod clamp 1704 is configured to clamp onto and suspend a rod string at certain times during a POH or RIH operation. The rod positioner assembly 1706 is disposed above the rod clamp 1704 via a set of hydraulic raising cylinders 1708. The rod positioner assembly 1706 is configured to grip and support the rod string at certain times during the POH or RIH operations. In certain example embodiments, the rod positioner assembly 1706 is configured to hold the rod string in place to resist torque applied to the rod string. In certain example embodiments, the rod positioner assembly 1706 is configured to be raised or lowered with respect to the rod clamp 1704 via the hydraulic raising cylinders 1708. The rod positioner assembly 1706 includes a rod opening 2102 formed therethrough for receiving and engaging a rod. The opening 2102 is closable in order to clamp onto and position the rod. The base 1702 of the tong system is couplable to the top of a wellhead, a blowout preventer (BOP) on the wellhead, or wellhead accessories.

The tong assembly 1710 is configured to engage a rod string at the junction between a first rod of the rod string and the second rod of the rod string, or the junction between a rod and a rod string. The second rod of the rod string may also be called the remainder of the rod string. In a POH operation, the tong assembly 1710 is configured to unthread or decouple the first rod of the rod string from the second rod of the rod string. In a RIH operation, the tong assembly 1710 is configured to thread or couple the rod to a rod string. The tong assembly 1710 is disposed on a horizontal track 1718 on which the tong assembly 1710 can slide between a disengaged position (FIG. 17) and an engaged position (FIG. 18). In the engaged position, the tong assembly 1710 is disposed above and aligned with the rod positioner assembly 1706. In the disengaged position, the tong assembly 1710 is out of alignment with the rod positioner assembly 1706 or to the side of the rod position 1706. In certain example embodiments, the horizontal track 1718 is disposed on a riser 1716, which is disposed on the base 1702. In certain example embodiments, the tong assembly 1710 further includes a centralizer guide 1720, also called a lower guide, one or more spring loaded supports 1722, stabilizing block 1724, and a rod tong 1726. In an example embodiment, the centralizer guide 1720 is disposed above the rod tong 1726.

The centralizer guide 1720 is configured to receive a rod therethrough and align the rod with the rod tong 1726 such that the rod is in the appropriate position for coupling to a rod string by the rod tong 1726. In certain example embodiments, the centralizer guide 1720 includes an expandable opening configured to accommodate rods of various sizes, and to accommodate easy disengagement of the tong assembly 1710 from a rod or rod string.

The spring loaded supports 1722 support the rod tong 1726 such that the rod tong 1722 has a certain degree of vertical motion to accommodate the upward movement of a rod as it is unthreaded from a rod string or the downward movement of a rod as it is threaded onto a rod string. The rod tong 1726 is configured to engage onto a junction between a rod and a rod string and either coupled the rod to the rod string or decouple the rod from the rod string. In a POH operation, the rod tong 1726 unthreads the rod from the rod string or a coupler on the rod string. In a RIH operation, the rod tong 1726 threads the rod onto the rod string or a coupler on the rod string. The stabilizing block 1724 provides a stable structure for the rod positioner assembly 1706 to engage onto as it holds a rod string stable against torque applied by the rod tong 1726 as it threads or unthreads a rod to or from a rod string.

The centralizer arm 1712 is coupled to the base 1702 and extends upward. The centralizer arm 1712 includes a guide device 1714 disposed at a distal end. In certain example embodiments, The centralizer arm 1712 is configured to move into a parked position, a neutral position, and a reach position. The centralizer arm 1712 and guide device 1714 lean away from the rod positioner assembly 1706 in the parked position. The guide device 1714 is directly above the tong assembly 1710 in the neutral position, and the centralizer arm 1712 extends across the rod positioner assembly 1706 in the reach position.

The centralizer arm 1712 includes a hinge 1728, allowing the centralizer arm 1712 and hinge forward towards and over the rod positioner assembly 1706 (FIG. 19), hinge backwards and away from the rod positioner assembly 1706 (FIG. 17), or align with the rod positioner assembly 1706 (FIG. 18). The guide device 1714 of the centralizer arm 1712, also known as an upper centralizer is configured to interface with a distal end of a rod that is suspended from the traveling block system 114. Specifically, in a POH operation, the centralizer arm 1712 hinges forward such that the guide device 1714 pushes the distal end of a rod that has been unthreaded from the rod string, and hanging from the traveling block system, towards and into the skate 120 of the carriage 118. In a RIH operation, the guide device 1714 receives the distal end of a rod as the traveling block system 114 picks up the rod from the carriage 118. As the guide device 1714 is in alignment with the rod positioner assembly 1706 in such a position, the distal end of the rod is aligned with the rod positioner assembly 1706 and also aligned with the rod string being suspended by the rod positioner assembly 1706. Thus, the rod is in position to be threaded onto the rod string by the tong assembly 1710.

Figure 21:
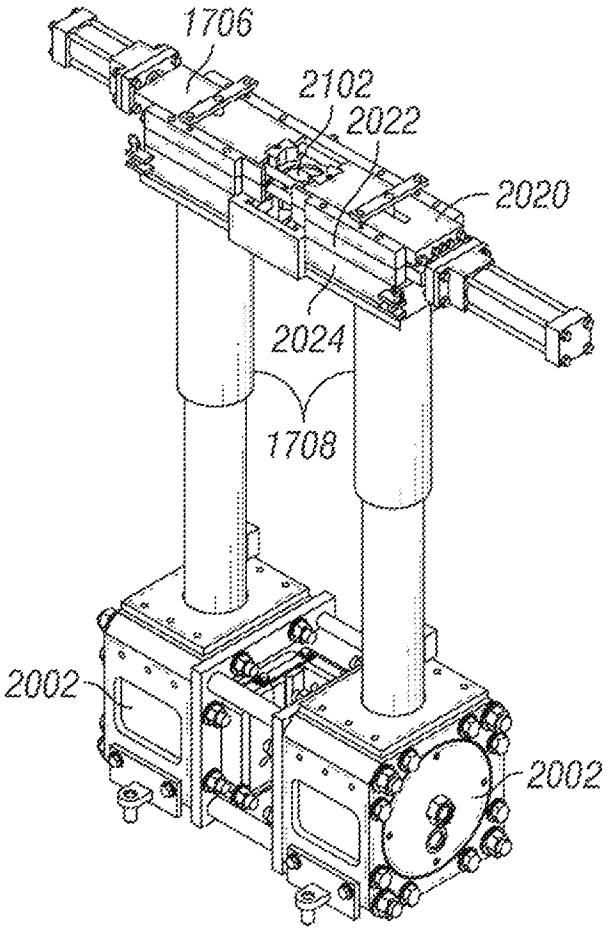
FIG. 21 illustrates a perspective view of a rod clamp and rod positioner assembly, in accordance with certain example embodiments.
Figure 20:
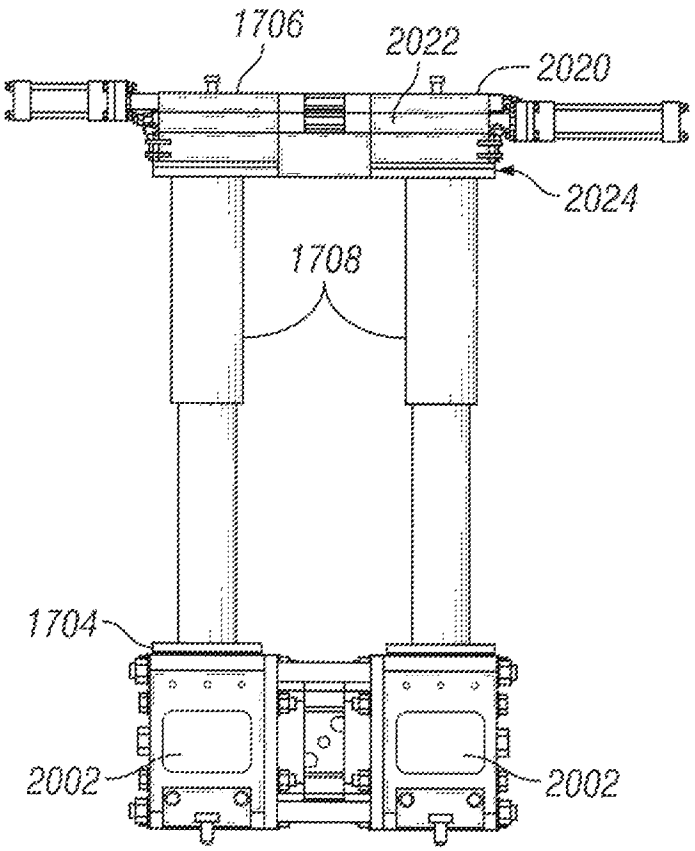
FIG. 20 illustrates a front view of a rod clamp and rod positioner assembly, in accordance with certain example embodiments.
Figure 22:
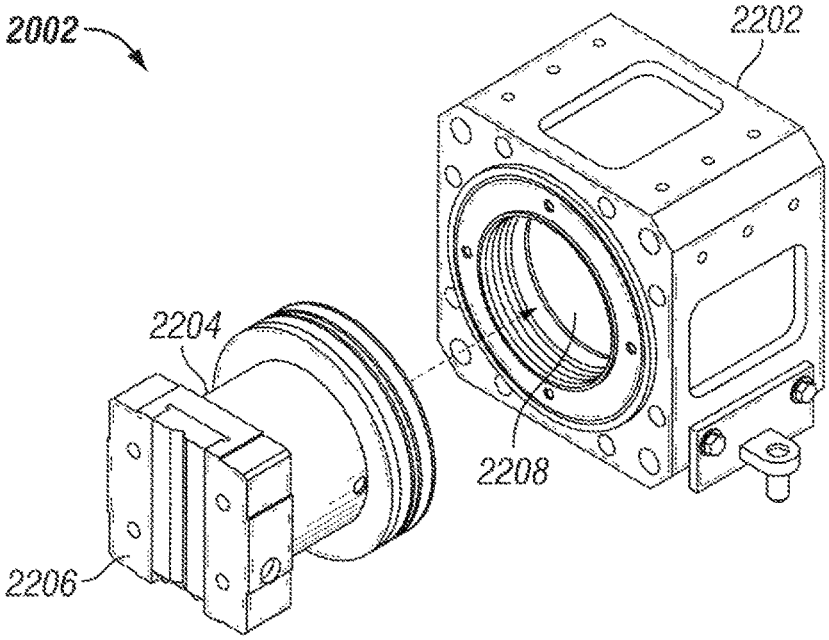
FIG. 22 illustrates an exploded view of a clamp block of the rod clamp, in accordance with certain example embodiments.

FIGS. 20 and 21 respectively illustrate a front view and a perspective view of the rod clamp 1704, the rod positioner assembly 1706, and the hydraulic cylinders 1708, in accordance with example embodiments of the present disclosure. Referring to FIGS. 20 and 21, in certain example embodiments, the rod clamp 1704 is made of two identical clamp blocks 2002 disposed facing each other and configured to receive and hold a rod therebetween. FIG. 22 illustrates an exploded view of the clamp blocks 2002, in accordance with example embodiments. Referring to FIG. 22, each clamp block includes a cylinder body 2202 and a clamp piston 2204. In certain example embodiments, the clamp piston includes a clamp insert 2206 disposed as a distal end. In certain example embodiments, the clamp piston 2204 is disposed within an opening 2208 of the cylinder body 2202. The clamp piston 2204 is configured to extend and retract with respect to the cylinder body 2202. As the rod clamp 1704 includes two clamp blocks 2002 facing each other, the two respective pistons 2204 extend towards each or retract away from each other. Thus, when a rod a dispose between the two clamp blocks, extension of the pistons 2204 engages the respective clamp inserts 2206 onto the rod, thereby holding the rod. In one example embodiments, movement of the clamp piston 2204 is controlled hydraulically. In certain other example embodiments, movement of the clamp piston 2204 is not limited to hydraulic actuation but can be moved by other means, including compressed air and the like.

Figure 23A:
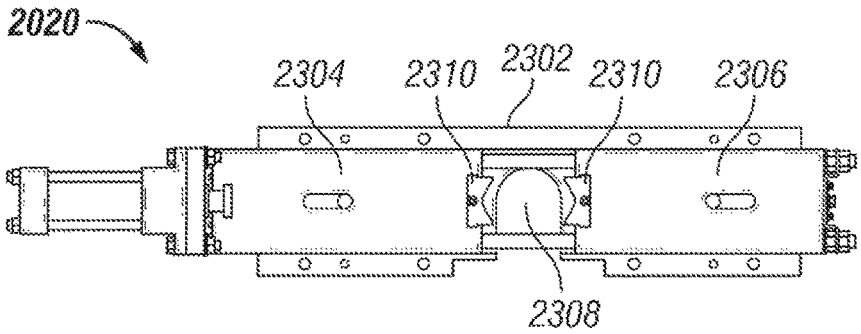
FIG. 23*a* illustrates a top view of a rod coupling clamp in an open position, in accordance with certain example embodiments.
Figure 23B:
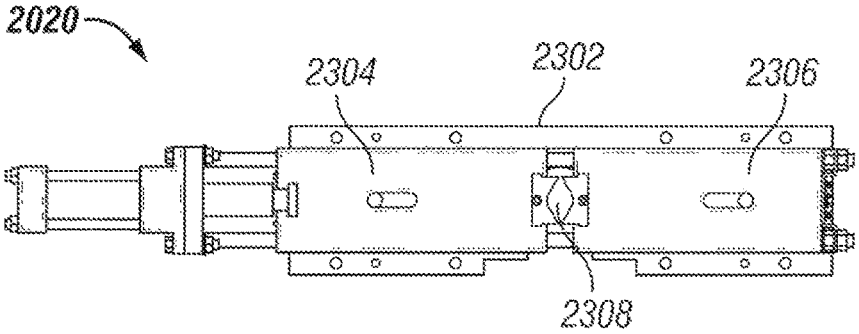
FIG. 23*b* illustrates a top view of the rod coupling clamp in a closed position, in accordance with certain example embodiments.

In certain example embodiments, the rod positioner assembly 1706 includes a first layer comprising a rod coupling clamp 2020, a second layer comprising a rod flat clamp 2022, and a third layer comprising a rod positioner 2024. FIG. 23*a* illustrates a top view of the rod coupling clamp 2020 in an open position, in accordance with example embodiments of the present disclosure. FIG. 23*b* illustrates a top view of the rod coupling clamp 2020 in a closed position, in accordance with example embodiments. Referring to FIGS. 23*a* and 23*b*, the rod coupling clamp 2020 further includes a base 2302 having an opening 2308 formed therein configured to receive a rod. In certain example embodiments, the rod coupling clamp 2020 further includes a first clamp arm 2304 and a second clamp arm 2306 disposed on the base 2302 on opposite sides of the opening 2308. Each of the first clamp arm 2304 and the second clamp arm 2306 includes a jaw 2310 disposed adjacent the opening 2308 and facing each other. In certain example embodiments, the first clamp arm 2304 and the second clamp arm 2306 are slidable towards and away from each other on the base 2302. In such example embodiments, when the first clamp arm 2304 and the second clamp arm 2306 slide towards each other, the jaws 2310 engage over the opening 2308 and gradually close the opening 2308, as shown in the closed position of FIG. 23*b*. Thus, when a rod is disposed through the opening 2308, and the clamp arms 2306 are configured to engage, the jaws 2310 engage onto the rod coupling, holding it in place. Specifically, in certain example embodiments, when the jaws 2310 of the rod coupling clamp 2020 engage onto a second rod of a rod string, the rod coupling clamp 2020 is configured to hold the second rod coupling for torque such that when the rod tong 1710 applies a torque to unthread a first rod of the rod string from the second rod, the applied torque on the second rod is resisted by the rod coupling clamp 2020. Thus, the second rod will not move, which forces the break to occur between the first rod and the second rod, as desired. In certain example embodiments, without the rod coupling clamp 2020, the rod string could break at a lower joint (e.g., between the coupler and the second rod).

Figure 24A:
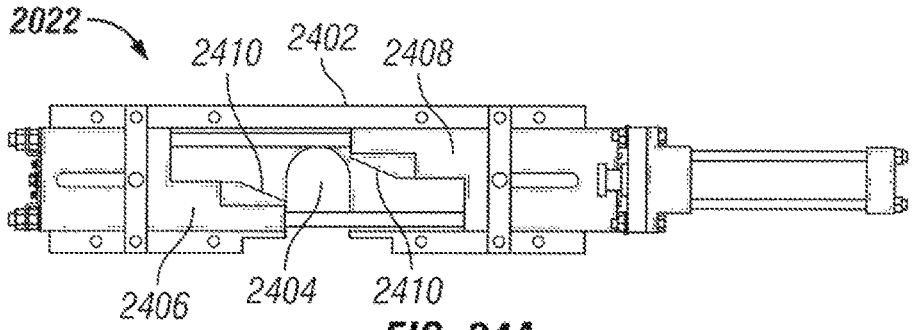
FIG. 24*a* illustrates a top view of a rod flat clamp in an open position, in accordance with certain example embodiments of the present disclosure.
Figure 24B:
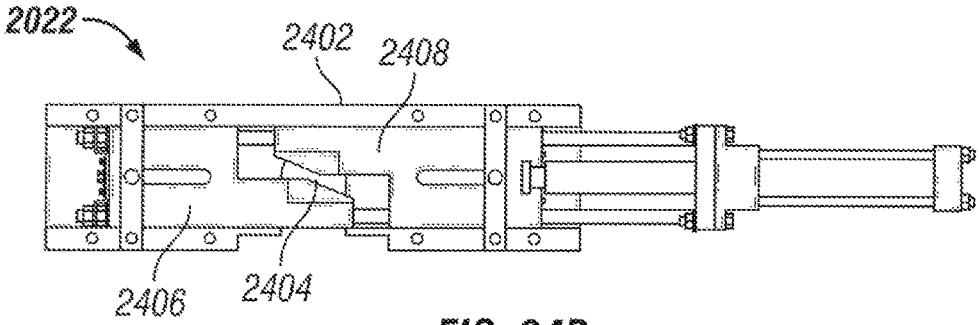
FIG. 24*b* illustrates a top view of the rod flat clamp in a closed position, in accordance with certain example embodiments.

FIG. 24*a* illustrates a top view of the rod flat clamp 2022 in an open position, in accordance with example embodiments of the present disclosure. FIG. 24*b* illustrates a top view of the rod flat clamp 2022 in a closed position, in accordance with example embodiments. Referring to FIGS. 24*a* and 24*b*, the rod flat clamp 2022 includes a base 2402 having an opening 2404 formed therein configured to receive a rod. In certain example embodiments, the rod flat clamp 2022 further includes a first flat arm 2406 and a second flat arm 2408 disposed on the base 2402 on opposite sides of the opening 2404. Each of the first flat arm 2406 and the second flat arm 2408 includes an angled flat 2410 disposed adjacent the opening 2404 and complimentarily angled with respect to each other. In certain example embodiments, the first flat arm 2406 and the second flat arm 2408 are slidable towards each other on the base 2402. In such example embodiments, when the first flat arm 2406 and the second flat arm 2408 slide towards each other, the flat arms 2406, 2408 and the flats 2410 engage over the opening 2404 and gradually close off the opening 2404, as shown in the closed position of FIG. 24*b*. In certain example embodiments, a rod is received through the opening 2404 when the rod flat clamp 2022 is in the open position. The first flat arm 2406 and the second flat arm 2408 are configured to slide towards each other and the rod until the flat arms 2406, 2408 cannot engage any further, thereby gripping the rod between the flats 2410. Specifically, in certain example embodiments, the rod includes one or more flat edges. Thus, as the flat arms 2406, 2408 engage the rod, the angled flats 2410 of the flat arms 2406, 2408 find the complimentary flat edges of the rod and hold the rod in place via mating of the angled flats 2410 to the flat edges of the rod. As the flat arms 2406, 2408 find and engage the flat edges of the rods, the rod is being disposed into a specific position in which its flat edges are aligned with the flats 2410. Thus, the rod flat clamp 2022 positions and holds the rod at such an angle. In certain example embodiments, without the rod flat clamp 2022, the rod string could break at a lower joint (e.g., between the second rod and the third rod).

Figure 25A:
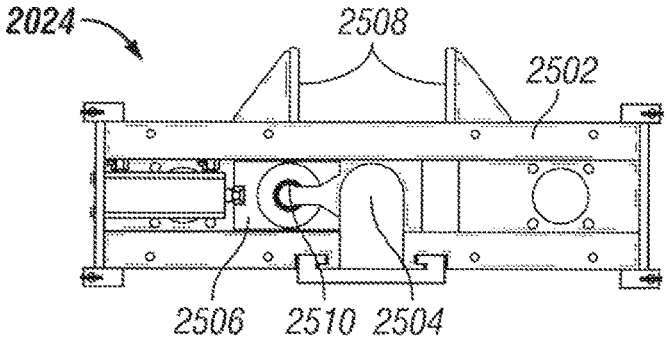
FIG. 25*a* illustrates a top view of a rod positioner in an open position, in accordance with certain example embodiments of the present disclosure.
Figure 25B:
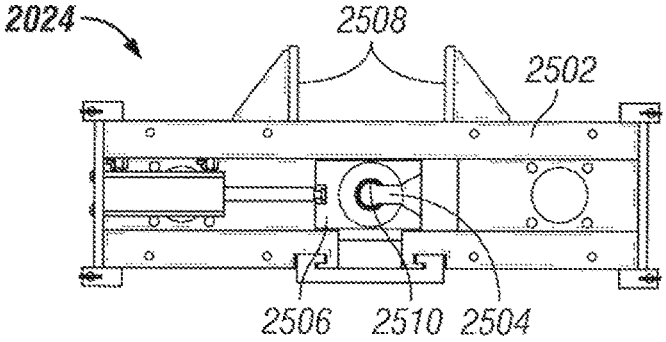
FIG. 25*b* illustrates a top view of the rod positioner in a closed position, in accordance with example embodiments.

FIG. 25*a* illustrates a top view of rod positioner 2024 in an open position, in accordance with example embodiments of the present disclosure. FIG. 25*b* illustrates a top view of the rod positioner 2024 in a closed position, in accordance with example embodiments. Referring to FIGS. 25*a* and 25*b*, the rod positioner 2024 includes a base 2502 having an opening 2504 formed therein configured to receive a rod. In certain example embodiments, the rod positioner 2024 further includes a rod string holder 2506 disposed on the base 2502 and adjacent the opening 2504 in the open position. The rod string holder 2506 includes an orifice 2510 configured to retain a rod therein. The rod string holder 2506 is slidable on the base 2502 towards between being adjacent the opening 2504 of the base 2502 and being over the opening 2504 of the base 2502. In certain example embodiments, a rod is received through the opening 2504 when the rod positioner 2024 is in the open position. The rod string holder 2506 is then configured to slide towards and over the opening 2504 such that the rod string holder 2506 engages around the rod, retaining the rod within the orifice 2510. Thus, the rod is gripped by the rod string holder 2506. In certain example embodiments, the rod positioner 2502 supports the weight of a rod string during certain times. For example, in certain embodiments, the rod string is held by the rod positioner 2502 when the rod clamp 1704 is released. This allows the rod strings to be moved up and down as it is aligned with the tong 1710. In certain example embodiments, the rod positioner 2502 holds and raises the rod string via the hydraulic cylinders 1708. In certain example embodiments, the rod positioner 2502 further includes set of grips 2508 extending from the base 2502. The grips 2508 are configured to receive the stabilization block 1724 therebetween. Thus, as the rod positioner assembly 1706 holds the rod string for torque, at least a portion of the torque is translated to the rod positioner assembly 1706. Thus, the rod positioner assembly 1706 itself is further stabilized for torque by the stabilization block 1724.

In certain example embodiments, the rod coupling clamp 2020, the rod flat clamp 2022, and the rod positioner 2024 are stacked on top of one another such that their respective openings 2308, 2404, 2504 are aligned and configured to collectively receive a rod therethrough. In certain example embodiments, engagement of the rod positioner assembly 1706 onto a rod includes the collective engagement of the rod coupling clamp 2020, the rod flat clamp 2022, and the rod positioner 2024 onto the rod, which includes moving each of the rod coupling clamp 2020, the rod flat clamp 2022, and the rod positioner 2024 from their open positions to their closed positions. In certain example embodiments, in a RIH operation, the coupling clamp does not close.

Figure 26:
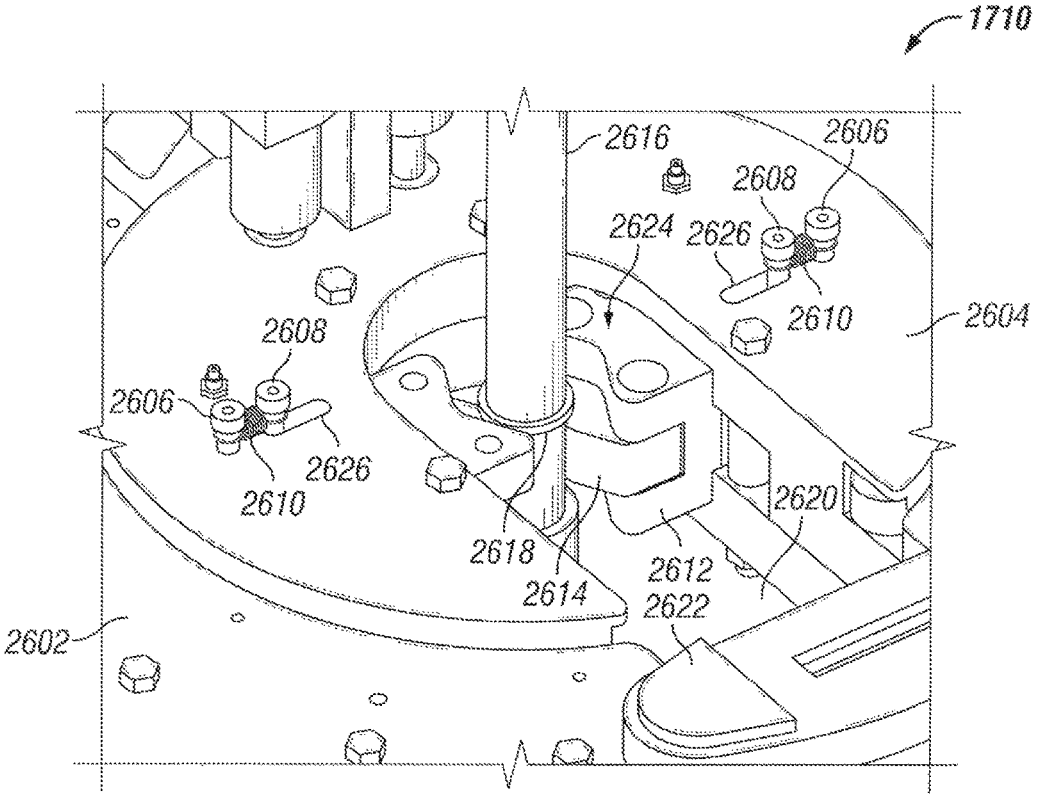
FIG. 26 illustrates a detailed perspective view of a portion of a rod tong, in accordance with certain example embodiments.

FIG. 26 illustrates a detailed perspective view of a portion of the rod tong 1710, in accordance with example embodiments of the present disclosure. Referring to FIG. 26, and in certain example embodiments, the rod tong 1710 further includes a tong base 2602, an upper plate 2604, and two jaw assemblies 2624. Each jaw assembly 2624 further includes a jaw block 2612 and a jaw insert 2614. The tong base 2602 provides housing and support for the jaw blocks 2612 and various mechanisms within the tong base 2602 which drive the jaw insert 2614 and the upper plate 2604. In certain example embodiments, the tong base 2602 also supports the centralizer guide 1720 disposed above the rod tong 1710. The tong base 2602 and the upper plate 2604 each include an opening 2620 formed from within the tong base 2602 and upper plate 2604 extending through an edge of the tong base 2602 and upper plate 2604. In certain example embodiments, a retractable barrier 2622 at the edge of the tong base 2602 closes the edge of tong base 2602, isolating the opening 2620. When the rod tong 1710 is in process to engage a rod 2616, the retractable barrier 2622 opens and the tong 1710 moves forward on to the rod 2616 then the retractable barrier 2622 closes. The jaw blocks 2612 are disposed within the opening and partially housed in the tong base 2602. The two jaw blocks 2612 face each other and each retain a jaw insert 2614. The jaw inserts 2614 likewise face each other and are configured to receive the rod 2616 therebetween.

In certain example embodiments, the jaw blocks 2612 are configured to extend out, engage the rod, and retract into an area within the tong base 2602. In certain example embodiments, a cam and roller within the tong base 2602 drives the jaw inserts 2614 to force out and to retract them. To the side of each jaw block 2612 are an outside screw 2606, an inside screw 2608, and a spring 2610 disposed between the outside screw 2606 and the inside screw 2608. In certain example embodiments, the outside and inside screws 2606, 2608 are disposed through a slot 2626 in the upper plate 2604, providing a path of horizontal movement for the inside screw 2608. Specifically, the outside screw 2606 is fixed to the upper plate 2604, and the inside screw 2608 is fixed to the jaw assembly 2624. The slot 2626 provides a movement track for the inside screw 2608 as the jaw die 2614 moves in and out with respect to the upper plate 2604. In certain example embodiments, the jaw dies 2614 are configured to engage an interfacing portion 2618 of the rod 2616 from opposite sides. Specifically, in certain example embodiments, the interfacing portion 2618 of the rod 2616 includes one or more flat surfaces and/or edges. In such example embodiments, the jaw inserts 2614 engage onto the flat surfaces or the edges to obtain a grip on the rod 2616 in which a working torque can be applied.

The upper plate 2604 and the jaw assembly 2624 are configured to rotate in circles about a center point between the jaw assemblies 2624 with respect to the tong base 2604.

When the jaw inserts 2614 are engaged onto the rod 2616, rotation of the upper plate 2604 and jaw assembly 2624 rotates the rod 2616. Thus, the rod 2616 can be threaded onto or unthreaded from a rod string depending on the direction of rotation.

Figure 27:
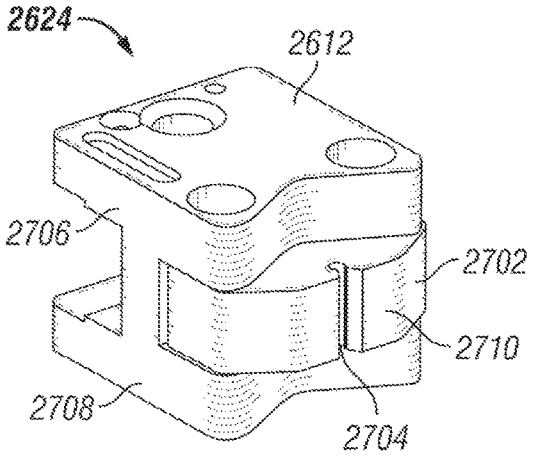
FIG. 27 illustrates a detailed view of a jaw assembly featuring a notched jaw die, in accordance with certain example embodiments.

FIG. 27 illustrates a detailed view of one embodiment of the jaw assembly 2624 featuring a notched jaw die 2702, in accordance with example embodiments of the present disclosure. Referring FIG. 27, the die block 2612 of the jaw assembly 2614 includes a top portion 2706 and a bottom portion 2708. A notched jaw die 2702 is partially disposed between the top portion 2706 and bottom portion 2708 of the die block 2612. The notched jaw die 2702 includes a notch 2704 formed on an outside surface 2710. The notch 2704 traverses the outside surface vertically such that the notch 2704 is aligned and parallel with the rod 2616 when the jaw die 2702 engages the rod 2616. In certain example embodiments, both the jaw assemblies 2614 of the tong assembly 1710 include notched jaw inserts 2702. The notches 2704 are configured to engage respective edges of the interfacing portion 2618 of the rod when the notched jaw inserts 2702 engage the rod 2616. Thus, the rod is held by the notches 2704, thereby facilitating twisting of the rod 2616 for threading or unthreading. In certain example embodiments, the notched jaw inserts 2702 engage one or more flats of the rod 2616.

Figure 28:
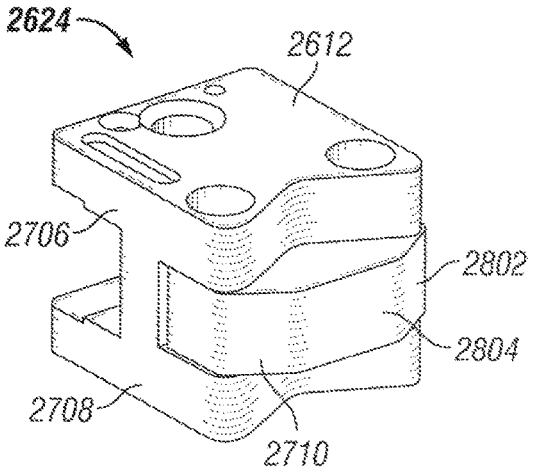
FIG. 28 illustrates a detailed view of a jaw assembly featuring a flat jaw die, in accordance with certain example embodiments.

FIG. 28 illustrates a detailed view of one embodiment of the jaw assembly 2624 featuring a flat jaw die 2802, in accordance with example embodiments of the present disclosure. Referring FIG. 28, a flat jaw die 2802 is partially disposed between the top portion 2706 and bottom portion 2708 of the die block 2612. The flat jaw die 2802 includes a flat 2804 formed on the outside surface 2710. In certain example embodiments, both the jaw assemblies 2614 of the tong assembly 1710 include the flat jaw die 2802. When the flat jaw inserts 2802 are configured to engage onto the rod 2616, the flats 2804 are configured to engage with flats on the interfacing portion 2618 of the rod 2616. Thus, the rod 2616 is held in position by the flat 2804, thereby facilitating twisting of the rod 2616 for threading or unthreading.

Figure 29:
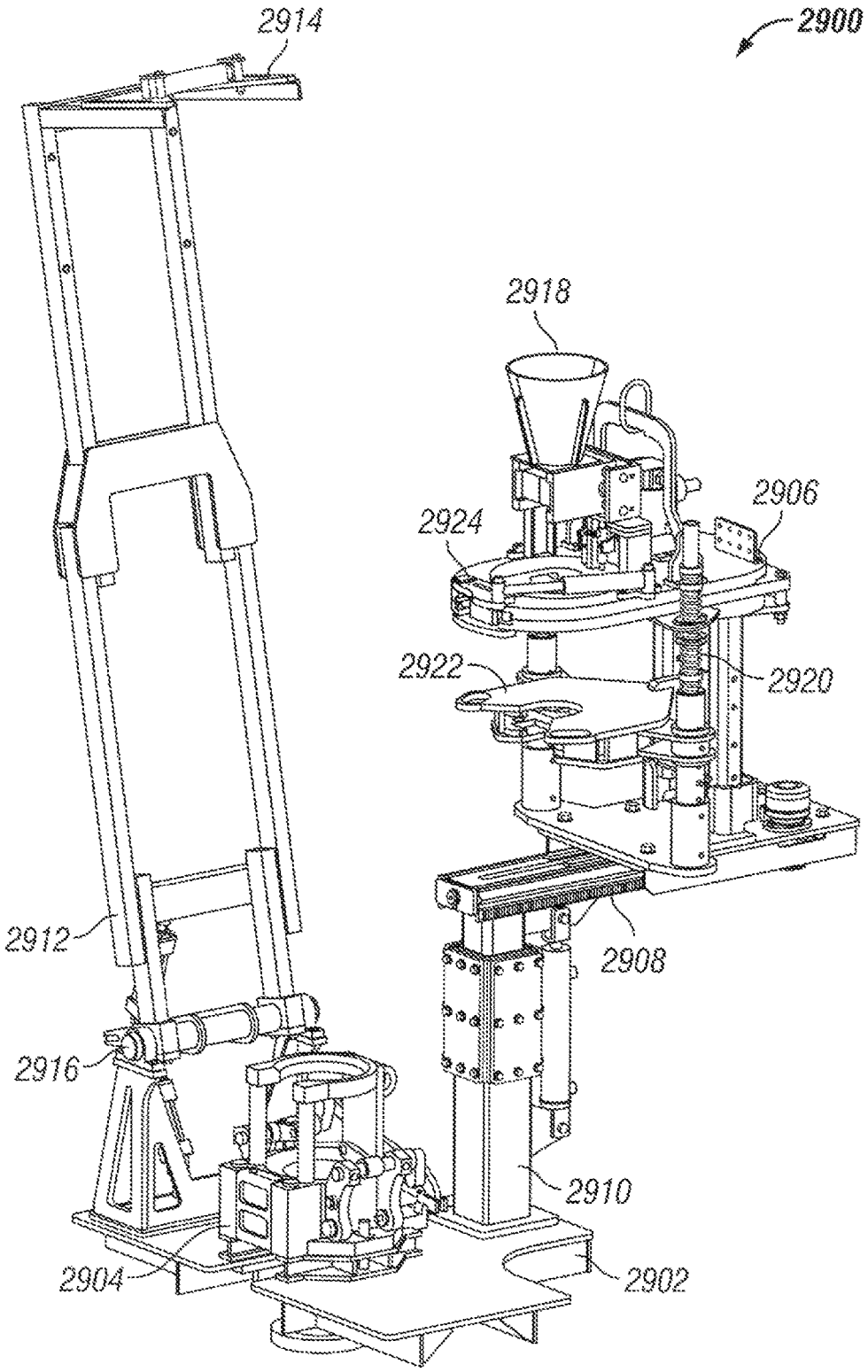
FIG. 29 illustrates a tubular tong system, in accordance with certain example embodiments of the present disclosure.

FIG. 29 illustrates a tubular tong system 2900, in accordance with example embodiments of the present disclosure. In certain example embodiments, such as in a POH operation, the tubular tong system 2900 is configured for a tubular string to be pulled out of hole and disassemble the tubulars of the tubular string for transport to the catwalk 104 and ultimately to the racking system 106. Conversely, in a RIH operation, the tubular tong system 2900 is configured to assemble additional tubulars onto the tubular string to be lowered further down-hole. Referring to FIG. 29, the tubular tong system 2900 includes a base 2902, a tubular slip 2904, a tubular tong assembly 2906, and a centralizer arm 2912.

In certain example embodiments, the tubular slip 2904 is disposed on the base 2902. The tubular slip 2904 is configured to hold and suspend a tubular string at certain times during a POH or RIH operation.

The tubular tong assembly 2906 is configured to engage a tubular string at the junction between a first tubular of the tubular string and the second tubular of the tubular string, or the junction between a tubular and a tubular string. The second tubular of the tubular string may also be called the remainder of the tubular string. In a POH operation, the tubular tong assembly 2906 is configured to unthread or decouple the first tubular of the tubular string from the second tubular of the tubular string. In a RIH operation, the tubular tong assembly 2906 is configured to thread or couple the tubular to a tubular string. The tubular tong assembly 2906 is disposed on a horizontal track 2908 on which the tong tubular tong assembly 2906 can slide between a disengaged position, as illustrated, and an engaged position. In the engaged position, the tubular tong assembly 2906 is disposed above and aligned with the tubular slip 2904. In the disengaged position, the tubular tong assembly 2906 is out of alignment with the tubular slip 2904 or to the side of the tubular position 2904. In certain example embodiments, the horizontal track 2908 is disposed on a riser 2910, which is disposed on the base 2902.

In certain example embodiments, the tubular tong assembly 2906 further includes a centralizer guide 2918, also called a lower guide, one or more spring loaded supports 2920, a backup jaw 2922, and a tubular tong 2924. In an example embodiment, the centralizer guide 2918 is disposed above the tubular tong 2924. The centralizer guide 2918 is configured to receive a tubular therethrough and align the tubular with the tubular tong 2924 such that the tubular is in the appropriate position for coupling to a tubular string by the tubular tong 2924. In certain example embodiments, the centralizer guide 2918 includes an expandable opening configured to accommodate tubulars of various sizes, and to accommodate easy disengagement of the tubular tong assembly 2906 from a tubular or tubular string.

The spring loaded supports 2920 support the tubular tong 2924 such that the tubular tong 2924 has a certain degree of vertical motion to accommodate the upward movement of a tubular as it is unthreaded from a tubular string or the downward movement of a tubular as it is threaded onto a tubular string. The tubular tong 2924 is configured to engage onto a junction between a tubular and a tubular string and either couple the tubular to the tubular string or decouple the tubular from the tubular string. In a POH operation, the tubular tong 2924 unthreads the tubular from the tubular string or a coupler on the tubular string. In a RIH operation, the tubular tong 2924 threads the tubular onto the tubular string or a coupler on the tubular string. In certain example embodiments, the backup jaw is configured to engage onto the tubular string and hold the tubular string against torque applied by the tubular tong 2924 as it rotates the tubular.

The centralizer arm 2912 is coupled to the base 2904 and extends upward. The centralizer arm 2912 includes a guide device 2914 disposed at a distal end. The centralizer arm 2912 includes a hinge 2916, allowing the centralizer arm 2912 and hinge forward towards and over the tubular slip 2904, hinge away from tubular slip 2904, or align with the tubular slip 2904. The guide device 2914 of the centralizer arm 2912, also known as an upper centralizer is configured to interface with a distal end of a tubular that is suspended from the traveling block system 114. Specifically, in a POH operation, the centralizer arm 2912 hinges forward such that the guide device 2914 guides the distal end of a tubular that has been unthreaded from the tubular string, and hanging from the traveling block system, towards and onto the skate 120 of the carriage 118. In a RIH operation, the guide device 2914 receives the distal end of a tubular as the traveling block system 114 picks up the tubular from the carriage 118. As the guide device 2914 is in alignment with the lower centralizer 2918 in such a position, the distal end of the tubular is aligned with a tubular string being suspended by the tubular slip 2904. Thus, the tubular is in position to be threaded onto the tubular string by the tubular tong assembly 2906.

Figure 30:
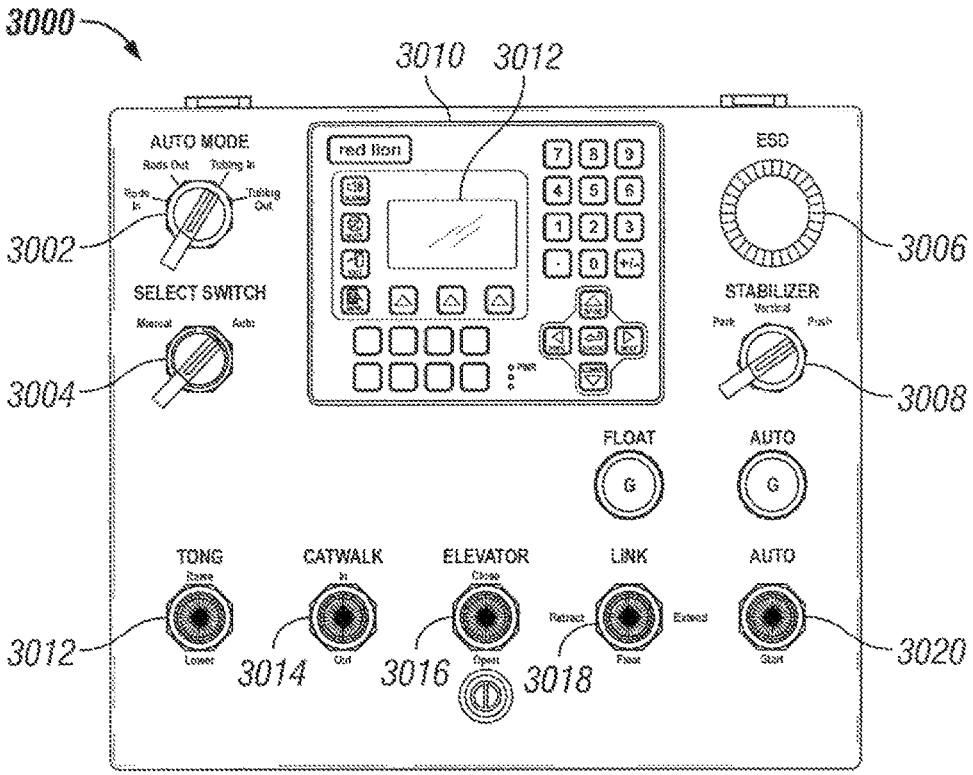
FIG. 30 illustrates an automation control panel for controlling certain aspects of the well service rig system, in accordance with certain example embodiments of the present disclosure.

FIG. 30 illustrates an automation control panel 3000 for controlling certain aspects of the well service rig system 100, in accordance with example embodiments of the present disclosure. In certain example embodiments, the control panel 300 includes a mode selector 3002, an automation selector 3004, an emergency shutdown (ESD) button 3006, and a stabilizer mode selector 3008, and user interface 3010. In certain example embodiments, the mode selector 3002 includes a knob used to select a process mode. For example, in the illustrated embodiments, the mode selector 3002 is used to select between a rod RIH mode, a rod POH mode, a tubular RIH mode, and a tubular POH mode. In certain example embodiments, the automation selector 3004 allows a user to select between manual control of the processes and an automated work process. The stabilizer mode selector 3008 can be used to select the position of the centralizer arm. In certain example embodiments, the control panel 3000 further includes selectors for controlling various components of the system 100. For example, the illustrated embodiments includes a tong controller 3012, a catwalk controller 3014, an elevator controller 3016, a link tilt controller 3018, and an automation start controller 3020.

In certain example embodiments, the user interface 3010 can be used to input values or settings for certain aspects of the processes. For example, the user interface 3010 can be used to define certain parameters associated with a certain action. Specifically, for example, the user interface 3010 may be used to define a torque, a duration, speed, number of revolutions, distance of travel, and the like. In certain example embodiments, the user interface 3010 can also be used to enter parameters associated with particular well conditions, like as rod or tubular grade, rod or tubular size, total number of segments, angle, and the like. In certain example embodiments, the user interface 3010 further includes a display 3012 for displaying information, prompts, status, feedback, and the like to the user. In certain example embodiments, the user interface 3010 may accept a security key to enable operational access to the control panel 3000. The user interface 3010 can also be used to define various other aspects of the system 100.

In certain other example embodiments, various other input devices can be used in place of the input devices shown in FIG. 30. For example, the input devices can be any combination of buttons, dials, knobs, switches, sliders, flippers, touch-screens and the like. In certain example embodiments, the control panel 300 may include other mode selectors used to control additional aspects of the system 100. Conversely, in certain other example embodiments, the control panel 300 may include less mode selectors or different mode selectors. Additionally, the arrangement and presentation of mode selectors and input devices may differ from that illustrated in FIG. 3000.

In certain example embodiments, the user interface 3010 is coupled to a central processing unit (CPU) including at least a processor and a memory configured to send signals to respective parts of the well service rig system 100 to carry out the desired process. In certain example embodiments, certain action sequences of various processes (e.g., rod RIH, rod POH, tubular RIH, tubular POH) are saved in the CPU and can be called upon through selections made in the control panel 3000. Such automation lessens the amount of input and interaction required from the user or operator during such processes.

Figure 31:
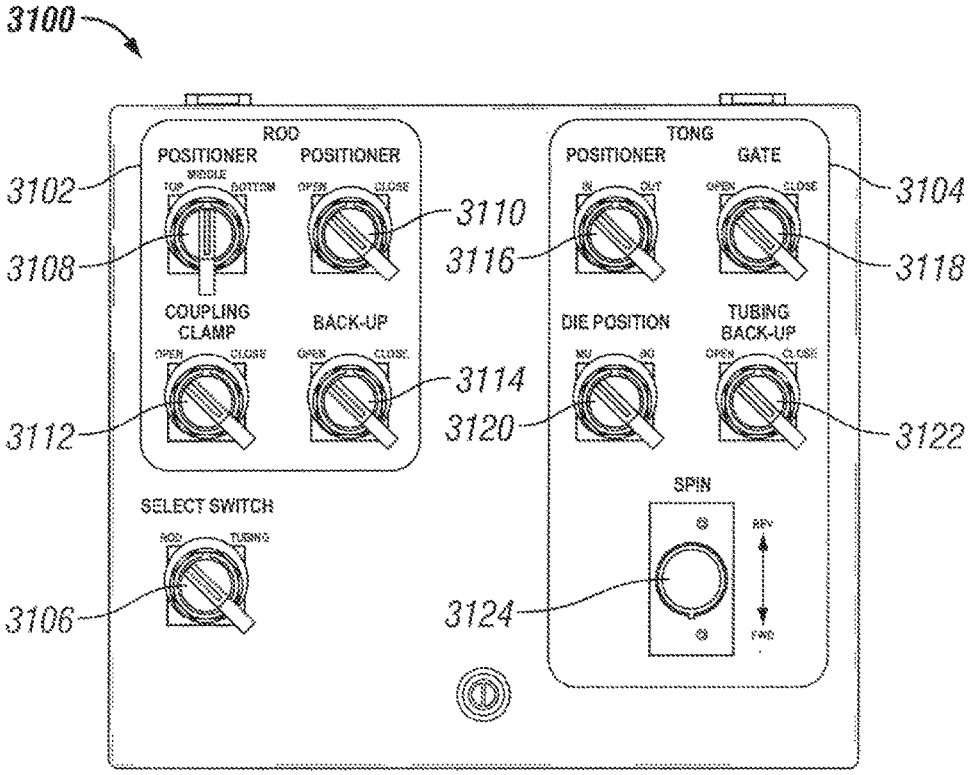
FIG. 31 illustrates a manual control panel for controlling certain aspects of the well service rig system, in accordance with certain example embodiments of the present disclosure.

FIG. 31 illustrates a manual control panel 3100 including rod positioner assembly controls 3102, tong controls 3104, and a rod/tubular selection switch 3106. In certain example embodiments, the rod positioner assembly controls 3102 include a rod positioner assembly raising control 3108, a rod positioner open/close control 3110, a rod coupling clamp open/close control 3112, and a rod back-up open/close control 3114. The rod positioner assembly raising control 3108 allows an operator to control raising and lowering of the rod positioner assembly.

The tong controls 3104 further include a positioner control 3116, a gate control 3104, a die position control 3120, a tubing back-up control 3122, and a tong spin control 3124. The positioner control 3116 is configured to move the tong 1710_on its horizontal base. The gate control 3104 is configured to open and close the retractable barrier 2622. The die position control 3120 is configured to control direction of engagement of the jaw of the tong for make-up or break-out positions. The tubing back-up control 3122 is configured to control engagement of the tubing back-up. The tong spin control 3124 is configured to control rotation of the tong for threading or unthreading a rod or tubular. The rod/tubular selection switch 3106 allows the user to input whether the intended operation is a rod operation or a tubular operation. In certain example embodiments, selection of rod or tubular will render certain control selections null if they do not pertain to the rod/tong selection.

The control panels illustrates in FIGS. 30 and 31 are representational examples of a wide range of possible control panel configurations and content, and is not meant to be limiting. It is understood that the well service rig system 100 includes many controllable parts that can be controlled in numerous ways and combinations to carry out number possible processes, which fall within the scope of the present disclosure.

Figure 32:
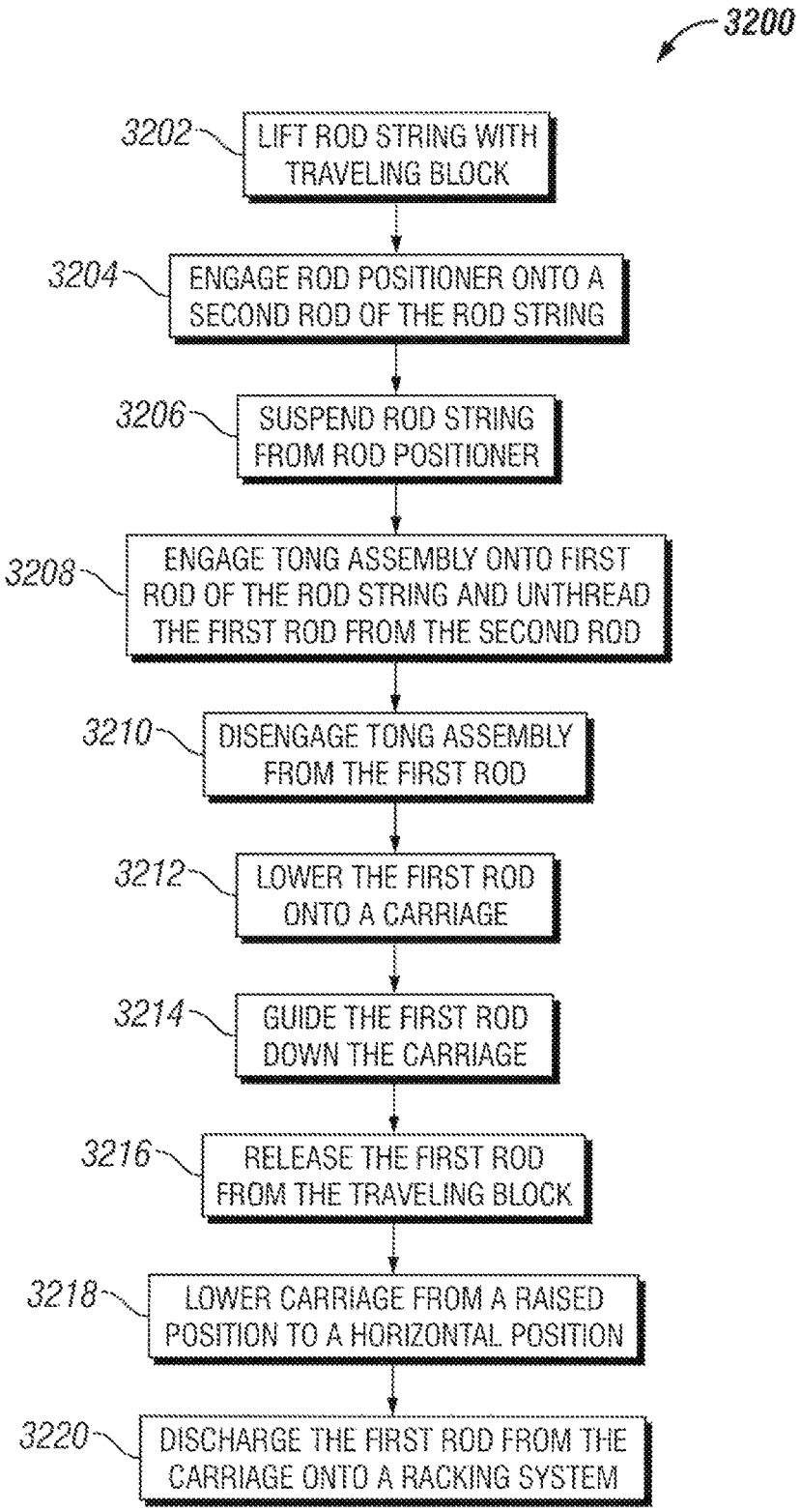
FIG. 32 is a flow chart illustrating a method of pulling a rod out of a well hole, also known as a rod POH process, in accordance with example embodiments of the present disclosure.

FIG. 32 is a flow chart illustrating a method 3200 of pulling a rod out of a well hole, also known as a rod POH process, in accordance with example embodiments of the present disclosure. In certain example embodiments, the method 3200 includes lifting a rod string through a disengaged rod positioner with a traveling block system until a junction between a first rod of the rod string and a second rod of the rod string is above the rod positioner (step 3202). In certain example embodiments, the traveling block system picks up the rod string via a rod elevator. In certain example embodiments, the traveling block system is travels on a vertical guide. In certain example embodiments, the vertical guide is parallel with a rod string and suspended from a mast, in which the mast is at an offset angle in relation to the vertical guide. In certain other example embodiments, the mast is parallel with the rod string with no offset. The method 3200 further includes engaging the rod positioner onto the second rod, wherein the rod positioner holds the second rod in a stationary position (step 3204). In certain example embodiments, engaging the rod positioner onto the second rod further includes closing a rod flat clamp and engaging one or more flats of the second rod and closing a rod coupler clamp and engaging a the second rod coupler of the second rod. In certain example embodiments, the rod positioner holds the rod string for torque and/or supports at least a portion of the weight of the rod string. Thus, the method 3200 includes suspending the rod string in the rod positioner (step 3406). In certain example embodiments, the method 3200 can also include engaging a rod clamp onto the rod string and supporting at least a portion of the weight by the rod clamp.

The method 3200 further includes engaging a tong assembly onto the first rod, and the tong assembly twists the first rod and unthreads the first rod from the second rod (step 3208). In certain example embodiments, the tong assembly twists the first rod and unthreads the first rod from a coupling on the second rod. After the first rod is decoupled from the second rod, the method 3200 includes disengaging the tong assembly from the first rod (step 3210). Thus, the tong assembly, which is slidable along a horizontal track, retracts away from the first rod. In certain example embodiments, the method further includes lowering and placing the first rod onto a carriage, wherein the carriage is raised at an angle (step 3212). In certain example embodiment, this includes raising the carriage from a horizontal position to a sloped and extended position if not already done so. In certain example embodiments, this also includes pushing and guiding a distal end of the first rod into a skate in the carriage. The method further includes guiding the first rod into the carriage by sliding the skate down the carriage until the first rod is fully disposed on the carriage (step 3214).

The method further includes extending the link tilt system and releasing the first rod from the elevator of the traveling block system when the first rod is fully disposed on the carriage (step 3216). The method 3400 further includes lowering the carriage into the horizontal position (step 3218). The method further includes tilting the carriage and discharging the first rod from the carriage onto a rod racking system (step 3220). In certain example embodiments, discharging the first rod from the carriage onto the rod racking system includes sending the rod from the carriage onto a rotating indexer, which carries the rod and rotates it from a first side facing the carriage to a second side facing the rod racking system. The rod then hits a discharging ramp as it is rotated through the rod racking system. The ramp discharges the rod out of the indexer and sends the rod onto a plurality of beams of the rod racking system. During this process the rod clamp closes and the rod positioner is lowered. The link tilt is then lowered, allowing the elevators to connect to the rod string and transfer the string weight to the rod elevator. The rod clamp then opens. In certain example embodiments, the method 3200 repeats to separate and pull out all the segments of the rod string.

Figure 33:
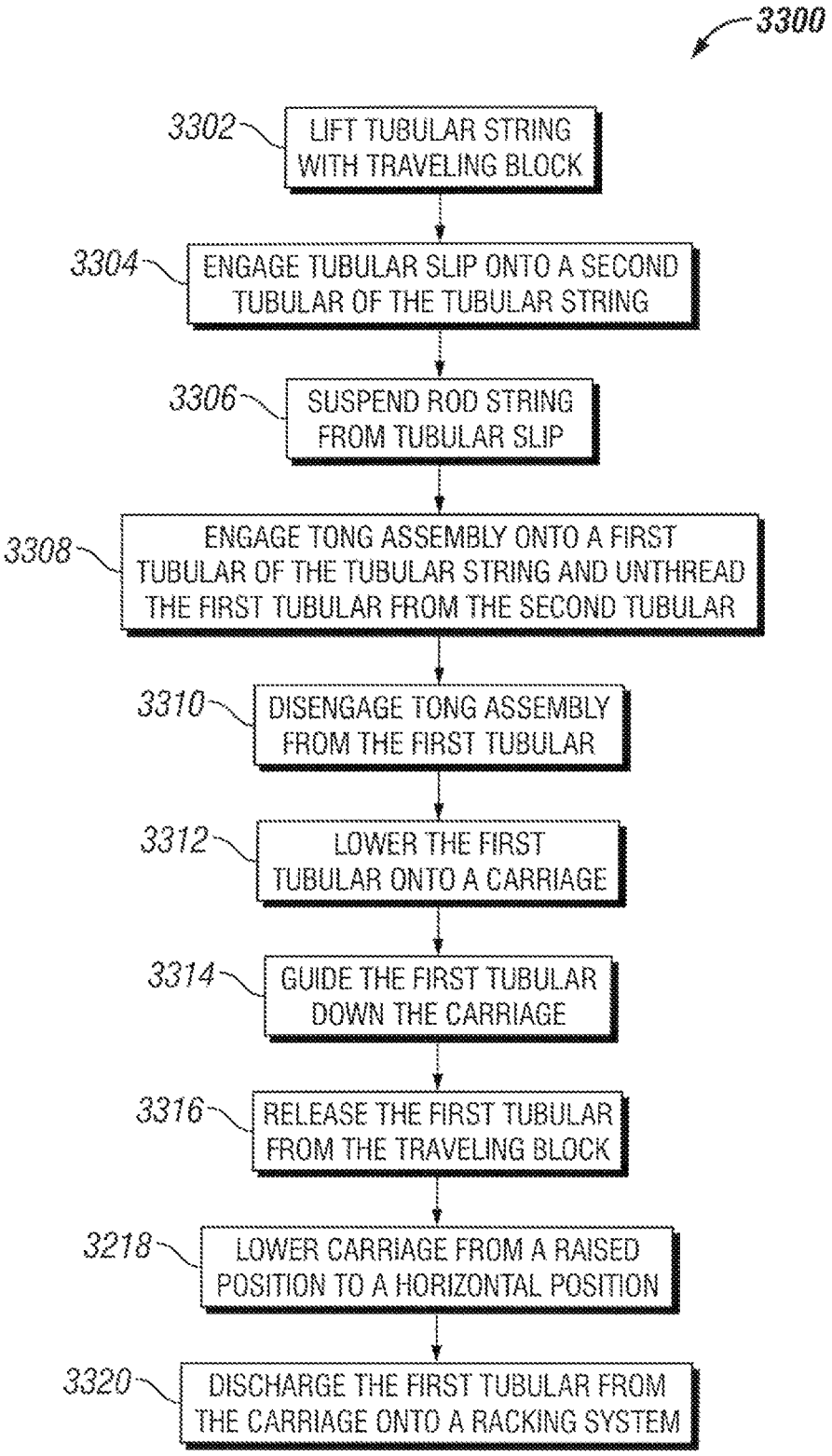
FIG. 33 is a flow chart illustrating a method of pulling a tubular out of a well hole, also known as a tubular POH process, in accordance with example embodiments of the present disclosure.

FIG. 33 is a flow chart illustrating a method 3300 of pulling a tubular out of a well hole, also known as a tubular POH process, in accordance with example embodiments of the present disclosure. In certain example embodiments, the method 3300 includes lifting a tubular string through a disengaged tubing slip with a traveling block system until a junction between a first tubular of the tubular string and a second tubular of the tubular string is above the tubing slip (step 3302). In certain example embodiments, the traveling block system picks up the tubular string via a tubular elevator. In certain example embodiments, the traveling block system travels on a vertical guide. In certain example embodiments, the vertical guide is parallel with a tubular string and suspended from a mast, in which the mast is at an offset angle in relation to the vertical guide. In certain other example embodiments, the mast is parallel with the tubular string with no offset. The method 3300 further includes engaging the tubing slip onto the second tubular, wherein the tubing slip holds the second tubular in a stationary position (step 3304). In certain example embodiments, the tubing slip holds the tubular string and supports at least a portion of the weight of the tubular string. Thus, the method 3300 includes suspending the tubular string in the tubing slip (step 3306).

The method 3300 further includes engaging a tong assembly onto the first tubular, and the tong assembly twists the first tubular and unthreads the first tubular from the second tubular (step 3308). In certain example embodiments, the tong assembly twists the first tubular and unthreads the first tubular from a coupling on the second tubular. After the first tubular is decoupled from the second tubular, the method 3300 includes disengaging the tong assembly from the first tubular (step 3310). Thus, the tong assembly, which is slidable along a horizontal track, retracts away from the first tubular. In certain example embodiments, the method further includes lowering and placing the first tubular onto a carriage, wherein the carriage is raised at an angle (step 3312). In certain example embodiment, this includes raising the carriage from a horizontal position to a sloped position if not already done so. In certain example embodiments, this also includes pushing and guiding a distal end of the first tubular into a skate in the carriage. The method further includes guiding the first tubular into the carriage by sliding the skate down the carriage until the first tubular is fully disposed on the carriage (step 3314).

The method further includes raising the link tilt system and releasing the first tubular from the elevator of the traveling block system when the first tubular is fully disposed on the carriage (step 3316). The method 3300 further includes lowering the carriage into the horizontal position (step 3318). The method further includes tilting the carriage and discharging the first tubular from the carriage onto a tubular racking system (step 3320). In certain example embodiments, discharging the first tubular from the carriage onto the tubular racking system includes sending the tubular from the carriage onto a rotating indexer, which carries the tubular and rotates it from a first side facing the carriage to a second side facing the tubular racking system. The tubular then hits a discharging ramp as it is rotated through the tubular racking system. The ramp discharges the tubular out of the indexer and sends the tubular onto a plurality of beams of the tubular racking system. During this process, the link tilt is lowered. This allows the elevators to connect to the tubular string, transferring the string weight to the tubular elevator. The tubing slip then opens. In certain example embodiments, the method 3300 repeats to separate and pull out all the segments of the tubular string.

Figure 34:
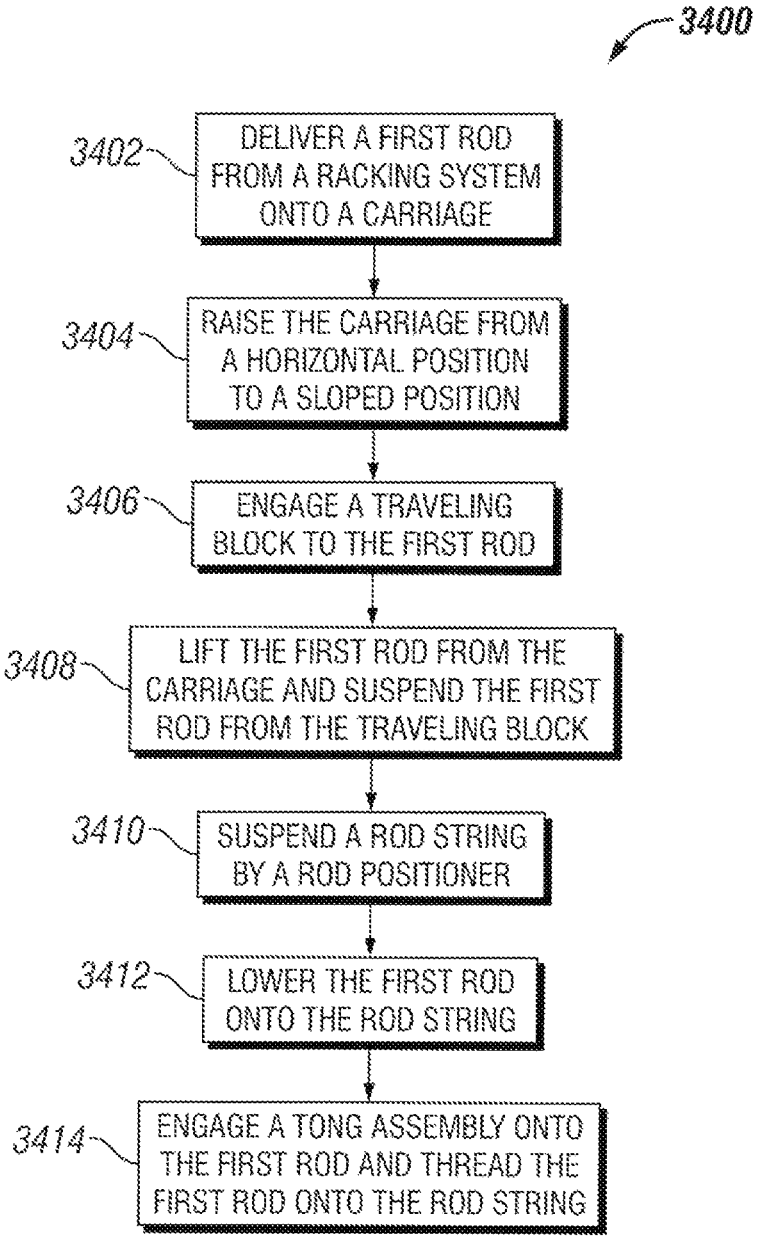
FIG. 34 is a flow chart illustrating a method of running a rod into a well hole, also known as a rod RIH process, in accordance with example embodiments of the present disclosure.

FIG. 34 is a flow chart illustrating a method 3400 of running a rod into a well hole, also known as a rod RIH process, in accordance with example embodiments of the present disclosure. In certain example embodiments, the method 3400 includes delivering a first rod from a rod racking system onto a carriage via an indexer (step 3402). In certain example embodiments, delivering the first rod from the rod racking system onto the carriage further includes disposing the first rod onto an indexer from a rod rack, rotating the indexer and transporting the first rod from a second side of the indexer facing the rod rack to a first side of the indexer facing carriage, and discharging the first rod from the indexer onto the carriage. In certain example embodiments a ramp coupled between the indexer and the carriage hits the rod as it rotates past and discharges it onto the carriage. The method 3400 further includes raising the carriage from a horizontal position into a sloped and extended position with the rod onboard (step 3404). The method 3400 further includes engaging a traveling block system to the first rod via a link tilt system and rod elevator of a traveling block system (step 3406), and lifting the first rod from the carriage and suspending the first rod from the traveling block system above a tong system (step 3408). In certain example embodiments, the tong system includes a tong assembly, an upper centralizer, a lower centralizer, a rod positioner, and a rod clamp. The upper centralizer aligns the first rod with the lower centralizer;

The method 3400 also includes engaging the rod positioner onto a rod string and suspending the rod string down-hole by the rod positioner (step 3410), allowing the the rod string to be released by the rod clamp. In certain example embodiments, engaging the rod positioner onto the rod string further includes raising to a determined position and engaging a rod flat backup onto one or more rod flats of the rod string.

The method 3400 further includes lowering the first rod through the lower centralizer of the tong assembly onto the rod string (step 3412), and engaging the tong assembly onto the first rod and threading the first rod onto the rod string, controlling the connection through precise measurement of CD (Circumferential Differential)(step 3414). After the first rod is coupled to the rod string, the rod positioner is disengaged from the rod string so that the rod string with the first rod can be lowered further into the well hole by the traveling block system. In certain example embodiments, this includes disengaging the rod flat backup from the one or more rod flats and disengaging the tong assembly from the first rod and the rod string and moving the positioner to a lower position, and lowering the rod string further into the well hole by the traveling block system. In certain example embodiments, in order to repeat the method 3400 to add another rod to the rod string, the rod clamp is again engaged onto the rod string via the first rod, and the elevator of the traveling block system is disengaged from the first rod so that the link tilt system can raise the elevator of the traveling block system and can pick up another rod from the catwalk. In certain example embodiments, the method 3400 is repeated until the rod string is fully assembled with the desired number of rods.

In certain example embodiments, engaging, disengaging, lowering and raising the rod positioner assembly, disengaging the rod positioner assembly, engaging and rotating the tong assembly, disengaging the tong assembly, engaging the rod clamp, disengaging the rod clamp, engaging the rod elevator, releasing the first rod from the rod elevator, or any combination thereof is performed in response to a command signal received from a remote or local controller. In certain other example embodiments, engaging, disengaging, lowering and raising the rod positioner assembly, disengaging the rod positioner assembly, engaging and rotating the tong assembly, disengaging the tong assembly, engaging the rod clamp, disengaging the rod clamp, engaging the rod elevator, releasing the first rod from the rod elevator, or any combination thereof is performed in response to a command from a controller in accordance with a preprogrammed set of instructions written on a non-transitory medium.

Figure 35:
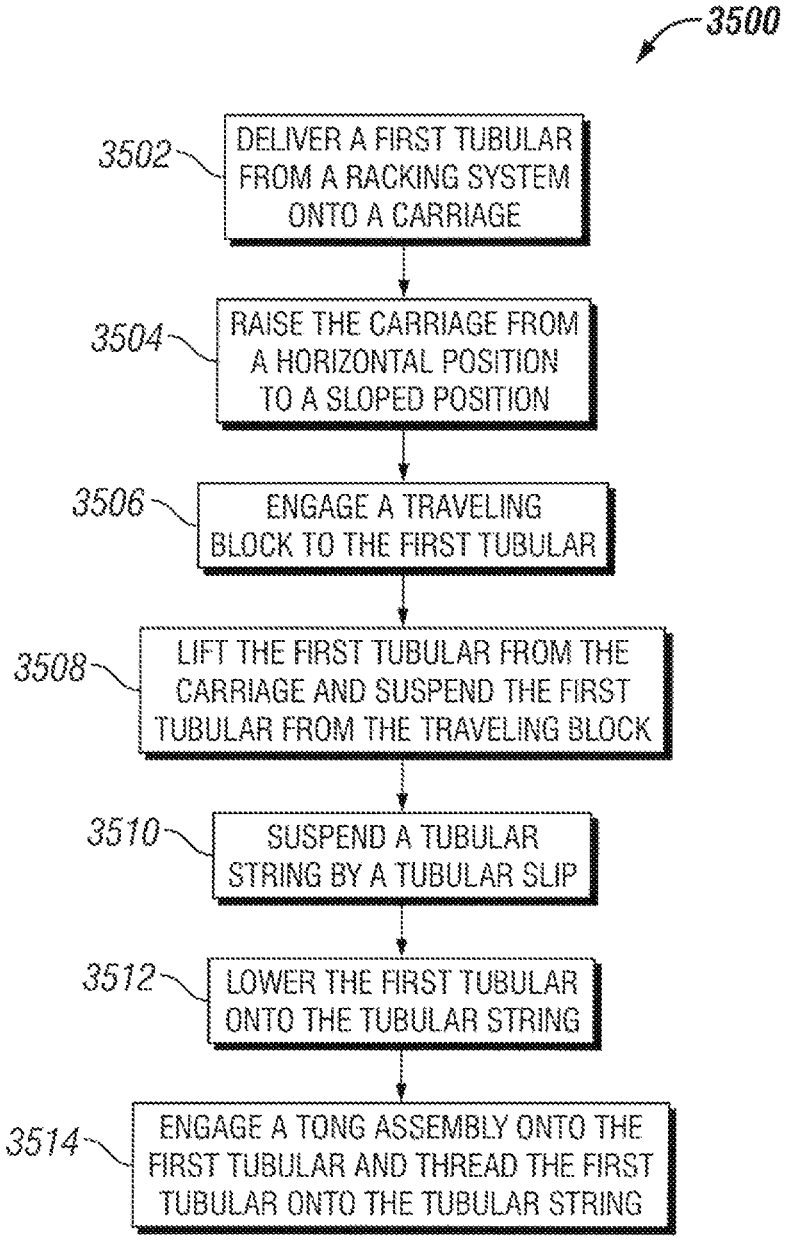
FIG. 35 is a flow chart illustrating a method of running tubulars into a well hole, also known as a tubular RIH process, in accordance with example embodiments of the present disclosure.

FIG. 35 is a flow chart illustrating a method 3500 of running tubulars into a well hole, also known as a tubular RIH process, in accordance with example embodiments of the present disclosure. In certain example embodiments, the method 3500 includes delivering a first tubular from a tubular racking system onto a carriage via an indexer (step 3502). In certain example embodiments, delivering the first tubular from the tubular racking system onto the carriage further includes disposing the first tubular onto an indexer from a tubular rack, rotating the indexer and transporting the first tubular from a second side of the indexer facing the tubular rack to a first side of the indexer facing carriage, and discharging the first tubular from the indexer onto the carriage. In certain example embodiments a ramp coupled between the indexer and the carriage hits the tubular as it rotates past and discharges it onto the carriage. The method 3500 further includes raising the carriage from a horizontal position into an extended sloped position with the tubular onboard (step 3504). The method 3500 further includes raising the link tilt system and engaging the elevators of the traveling block system to the first tubular (step 3506), and lifting the first tubular from the carriage and suspending the first tubular from the traveling block system above a tong system (step 3508). In certain example embodiments, the tong system includes a tong assembly, an upper centralizer, a lower centralizer, and a tubing slip. The upper centralizer aligns the first tubular with the lower centralizer;

The method 3500 also includes engaging the tubing slip onto a tubular string and suspending the tubular string down-hole by the tubing slip (step 3510). In certain example embodiments, the tubular string is at least partially supported by a tubing slip.

The method 3500 further includes lowering the first tubular through the lower centralizer of the tong assembly onto the tubular string (step 3512), and engaging the tong assembly onto the first tubular and threading the first tubular onto the tubular string (step 3514). In certain example embodiments, the method 3500 also includes controlling the connection by monitoring and controlling the torque of the tong. In certain example embodiments, the first tubular is threaded onto a coupling of the tubular string. After the first tubular is coupled to the tubular string, the weight is transferred to the elevator of the traveling block systems and the tubing slip is disengaged from the tubular string so that the tubular string with the first tubular can be lowered further into the well hole by the traveling block system. In certain example embodiments, in order to repeat the method 3500 to add another tubular to the tubular string, the tubing slip is again engaged onto the tubular string via the first tubular, and the traveling block system is disengaged from the first tubular so that the traveling block system can pick up another tubular from the catwalk. In certain example embodiments, the method 3500 is repeated until the tubular string is fully assembled with the desired number of tubulars.

In certain example embodiments engaging the tubing slip, disengaging the tubing slip, engaging the tong assembly, disengaging the tong assembly, moving the tong assembly, engaging the back-up jaw, engaging and rotating the upper tong jaw, disengaging the back-up jaw, disengaging the upper tong jaw, engaging the tubular elevator, disengaging the tubular elevator, or any combination thereof is performed in response to a command signal received from a remote or local controller. In certain other example embodiments, engaging the tubing slip, disengaging the tubing slip, engaging the tong assembly, disengaging the tong assembly, moving the tong assembly, engaging the back-up jaw, engaging and rotating the upper tong jaw, disengaging the back-up jaw, disengaging the upper tong jaw, engaging the tubular elevator, disengaging the tubular elevator, or any combination thereof is performed in response to a command from a controller in accordance with a preprogrammed set of instructions written on a non-transitory medium.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the example embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

We claim:

1. A tong system for handling rods, comprising:

a base;

a rod clamp disposed on the base, the rod clamp comprising a first clamp block and a second clamp block opposite the first clamp block, wherein the first clamp block comprises a first clamp piston and a first clamp insert disposed at a distal end of the first clamp piston, and the second clamp block comprises a second clamp piston and a second clamp insert disposed at a distal end of the second clamp piston, the first and second clamp inserts facing each other;

a rod positioner assembly coupled above the rod clamp via at least one hydraulic cylinder, the rod positioner assembly configured to position and hold a rod via an opening formed therein;

a tong assembly disposed on the base via a riser and a horizontal track, the tong assembly comprising a rod handling tong and a lower centralizer guide positioned above the rod handling tong, the lower centralizer guide configured to receive and align the first rod with the rod string and the rod handling tong configured to rotate a first rod, coupling or decoupling the first rod to or from the rod string; and a centralizer arm extending from the base to a height above the lower centralizer guide, the centralizer arm comprising a guide member and configured to guide the first rod to or from a carriage, wherein the rod positioner assembly, comprises:

a rod positioner comprising a first opening and a rod retainer configured to brace onto a support beam and support at least a portion of the weight of the rod;

a rod flat clamp comprising a second opening aligned with the first opening, the rod flat clamp comprising one or more angled clamp device configured to move towards the second opening, engage a flat surface on the rod, and hold the rod in such a position; and a rod coupling clamp comprising a third opening aligned with the first and second openings, the coupling clamp comprising one or more clamp devices configured to move towards the third opening, engage a rod coupling of the rod, and hold the rod coupling of the rod.

2. The tong system of claim 1, wherein the first clamp piston moves in and out of the first clamp block and the second clamp piston moves in and out of the second clamp block, pushing the first and second clamp inserts towards and away from each other, respectively, and wherein the first and second clamp inserts are configured to hold and support the rod there between.

3. The tong system of claim 1, wherein the at least one hydraulic cylinder is configured to move the rod positioner assembly up and down in relation to the rod clamp.

4. The tong system of claim 1, wherein the lower centralizer guide comprises an expandable centered guide opening.

5. The tong system of claim 4, wherein the expandable centered guide opening expands to allow disengagement of the tong from the rod and to receive rods of different diameters while keeping the rods in a centered position.

6. The tong system of claim 1, wherein the tong assembly travels along the horizontal and a vertical track between an engaged position and a disengaged position, wherein the tong assembly is aligned with the rod positioner assembly in the engaged position and to the side of the rod positioner in the disengaged position.

7. The tong system of claim 1, wherein the centralizer arm is configured to move between a parked position, a neutral position, and a reach position, wherein the centralizer arm and guide member lean away from the rod positioner assembly in the parked position, wherein the guide member is directly above the tong assembly in the neutral position, and wherein the centralizer arm extends across the rod positioner assembly in the reach position.

8. The tong system of claim 7, wherein the centralizer arm and the guide member are configured to guide a rod away from the tong assembly as it moves from the neutral position to the reach position.

9. The tong system of claim 7, wherein the centralizer arm and the guide member are configured to receive and centralize a rod over the tong assembly in the neutral position.

10. The tong system of claim 1, wherein the base is couplable to a blowout preventer, a wellhead, or a wellhead accessory.

11. The tong system of claim 1, wherein the tong assembly has a vertical range of motion with respect to the rod positioner assembly allowing the tong assembly to be disposed and aligned above the rod positioner assembly.

12. A tong system for handling rods, comprising:

a base;

a rod clamp disposed on the base, the rod clamp comprising a first clamp block and a second clamp block opposite the first clamp block, wherein the first clamp block comprises a first clamp piston and a first clamp insert disposed at a distal end of the first clamp piston, and the second clamp block comprises a second clamp piston and a second clamp insert disposed at a distal end of the second clamp piston, the first and second clamp inserts facing each other;

a rod positioner assembly coupled above the rod clamp via at least one hydraulic cylinder, the rod positioner assembly configured to position and hold a rod via an opening formed therein;

a tong assembly disposed on the base via a riser and a horizontal track, the tong assembly comprising a rod handling tong and a lower centralizer guide positioned above the rod handling tong, the lower centralizer guide configured to receive and align the first rod with the rod string and the rod handling tong configured to rotate a first rod, coupling or decoupling the first rod to or from the rod string; and a centralizer arm extending from the base to a height above the lower centralizer guide, the centralizer arm comprising a guide member and configured to guide the first rod to or from a carriage, wherein the first clamp piston moves in and out of the first clamp block and the second clamp piston moves in and out of the second clamp block, pushing the first and second clamp inserts towards and away from each other, respectively, and wherein the first and second clamp inserts are configured to hold and support the rod therebetween.

13. The tong system of claim 12, wherein the rod positioner assembly further comprises:

a rod positioner comprising a first opening and a rod retainer configured to brace onto a support beam and support at least a portion of the weight of the rod;

a rod flat clamp comprising a second opening aligned with the first opening, the rod flat clamp comprising one or more angled clamp device configured to move towards the second opening, engage a flat surface on the rod, and hold the rod in such a position; and a rod coupling clamp comprising a third opening aligned with the first and second openings, the coupling clamp comprising one or more clamp devices configured to move towards the third opening, engage a rod coupling of the rod, and hold the rod coupling of the rod.

14. The tong system of claim 12, wherein the at least one hydraulic cylinder is configured to move the rod positioner assembly up and down in relation to the rod clamp.

15. The tong system of claim 12, wherein the lower centralizer guide comprises an expandable centered guide opening.

16. The tong system of claim 15, wherein the expandable centered guide opening expands to allow disengagement of the tong from the rod and to receive rods of different diameters while keeping the rods in a centered position.

17. The tong system of claim 12, wherein the tong assembly travels along the horizontal and vertical track between an engaged position and a disengaged position, wherein the tong assembly is aligned with the rod positioner assembly in the engaged position and to the side of the rod positioner in the disengaged position.

18. The tong system of claim 12, wherein the centralizer arm is configured to move between a parked position, a neutral position, and a reach position, wherein the centralizer arm and guide member lean away from the rod positioner assembly in the parked position, wherein the guide member is directly above the tong assembly in the neutral position, and wherein the centralizer arm extends across the rod positioner assembly in the reach position.

19. The tong system of claim 18, wherein the centralizer arm and the guide member are configured to guide a rod away from the tong assembly as it moves from the neutral position to the reach position.

20. The tong system of claim 18, wherein the centralizer arm and the guide member are configured to receive and centralize a rod over the tong assembly in the neutral position.

21. The tong system of claim 12, wherein the tong assembly has a vertical range of motion with respect to the rod positioner assembly allowing the tong assembly to be disposed and aligned above the rod positioner assembly.

* * * * *